US007102072B2

(12) United States Patent
Kitayama

(10) Patent No.: US 7,102,072 B2
(45) Date of Patent: Sep. 5, 2006

(54) APPARATUS AND COMPUTER PROGRAM FOR DETECTING AND CORRECTING TONE PITCHES

(75) Inventor: Toru Kitayama, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 143 days.

(21) Appl. No.: 10/829,971

(22) Filed: Apr. 22, 2004

(65) Prior Publication Data

US 2004/0221710 A1 Nov. 11, 2004

(30) Foreign Application Priority Data

Apr. 22, 2003 (JP) ..... 2003-116656
Oct. 27, 2003 (JP) ..... 2003-366166

(51) Int. Cl.
*G10H 7/00* (2006.01)

(52) U.S. Cl. ..... 84/616; 84/454; 84/307 A; 84/735; 84/477 R

(58) Field of Classification Search ..... 84/616, 84/645, 477 R, 610, 654, 454, 735, 307 A
See application file for complete search history.

(56) References Cited

U.S. PATENT DOCUMENTS 4,321,853 A * 3/1982 Tumblin ..... 84/454
4,457,203 A * 7/1984 Schoenberg et al. ..... 84/454
4,627,323 A * 12/1986 Gold ..... 84/616
5,014,589 A * 5/1991 Obata ..... 84/735
5,287,789 A * 2/1994 Zimmerman ..... 84/477 R
5,447,438 A * 9/1995 Watanabe et al. ..... 434/307 A
5,477,003 A * 12/1995 Muraki et al. ..... 434/307 A
5,719,346 A 2/1998 Yoshida et al.
5,973,252 A * 10/1999 Hildebrand ..... 84/603
6,124,544 A * 9/2000 Alexander et al. ..... 84/616
6,657,114 B1 12/2003 Iwamoto

FOREIGN PATENT DOCUMENTS

JP 10-078791 3/1998

* cited by examiner

*Primary Examiner*—Jeffrey Donels
*Assistant Examiner*—Christina Russell
(74) *Attorney, Agent, or Firm*—Harness, Dickey & Pierce, PLC

(57) ABSTRACT

The tone pitch of a given tone waveform is detected by forming an envelope waveform of the given tone waveform, holding the level of the envelope waveform at each of the zero cross times of the given tone waveform and releasing such holding starting new holding when the level of the given tone waveform exceeds the held level of the envelope waveform, and determining the pitch of the given tone waveform based on the period between the adjacent zero cross times, A correction target note pitch is provided, to which the detected tone pitch of the given tone waveform is corrected. The detected tone pitch, the correction target note pitch and the amount of correction are exhibited for the user to visually understand the pitch correction.

15 Claims, 15 Drawing Sheets

Functional Configuration of Pitch Corrector

Hardware Configuration of Pitch Corrector

*Fig. 2* Functional Configuration of Pitch Corrector
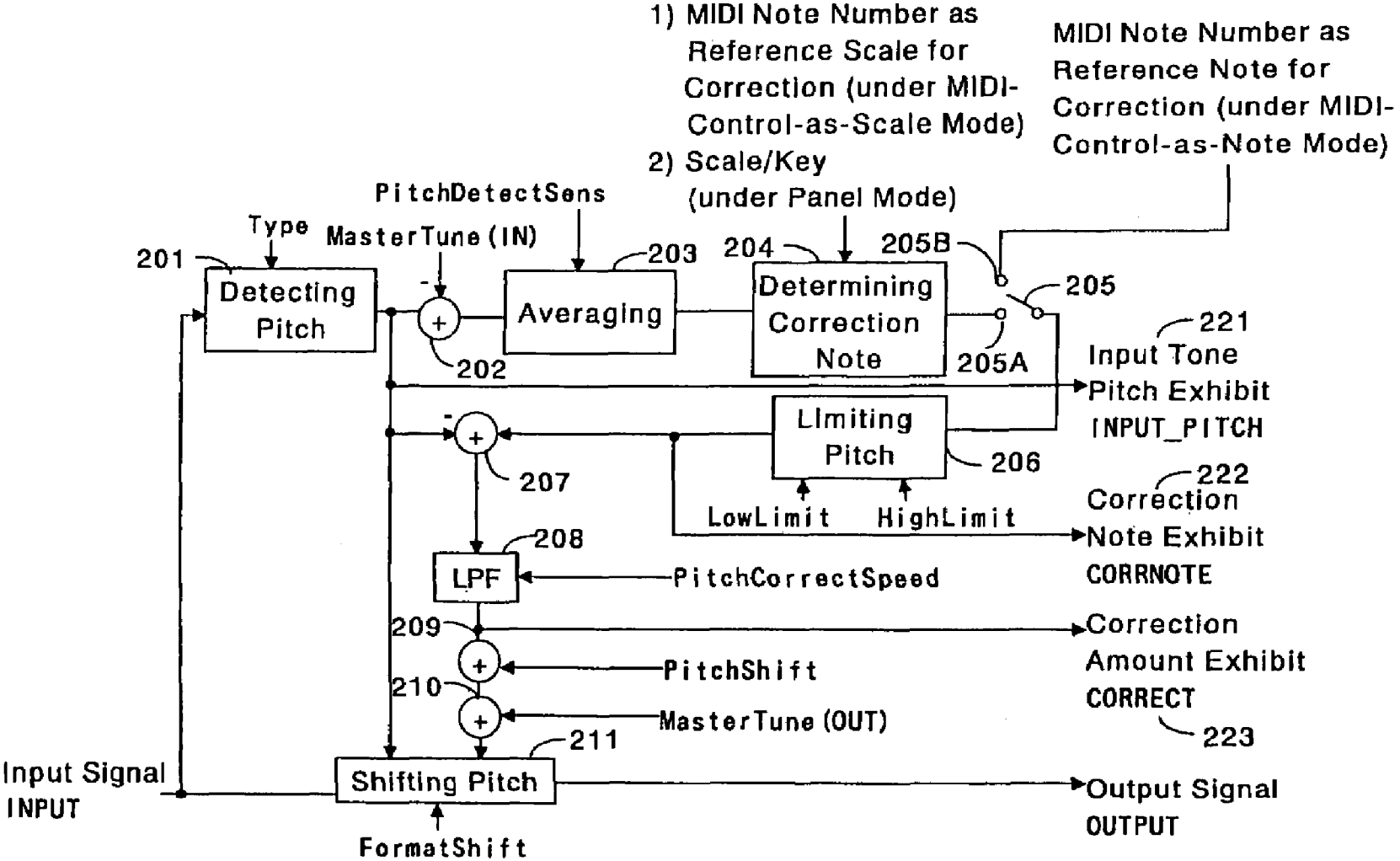

*Fig. 3a* Setting Window of Pitch Corrector
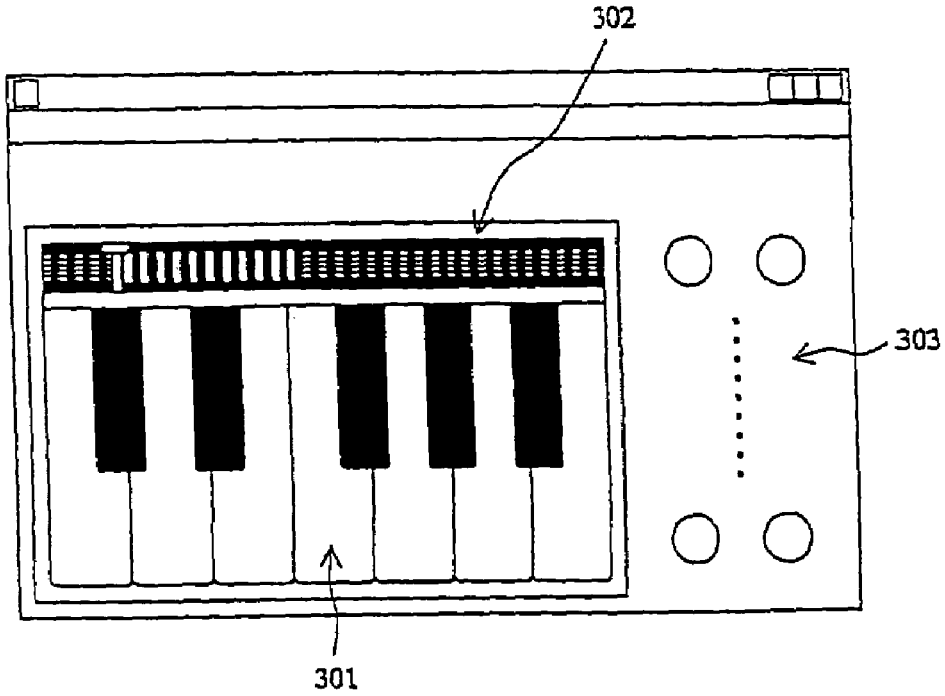
*Fig. 3b*
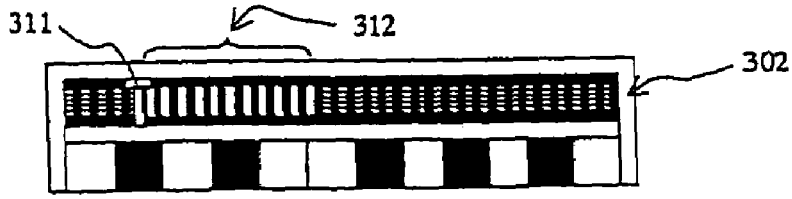
*Fig. 3c*
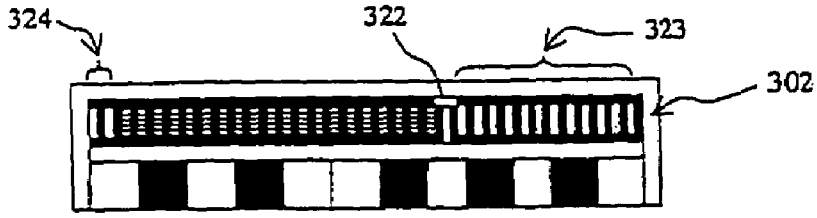
*Fig. 3d*
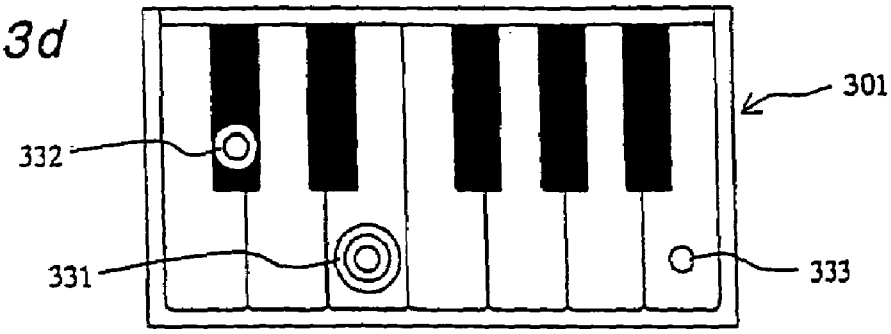

*Fig. 4* Functional Configuration of Key Illumination Control Unit
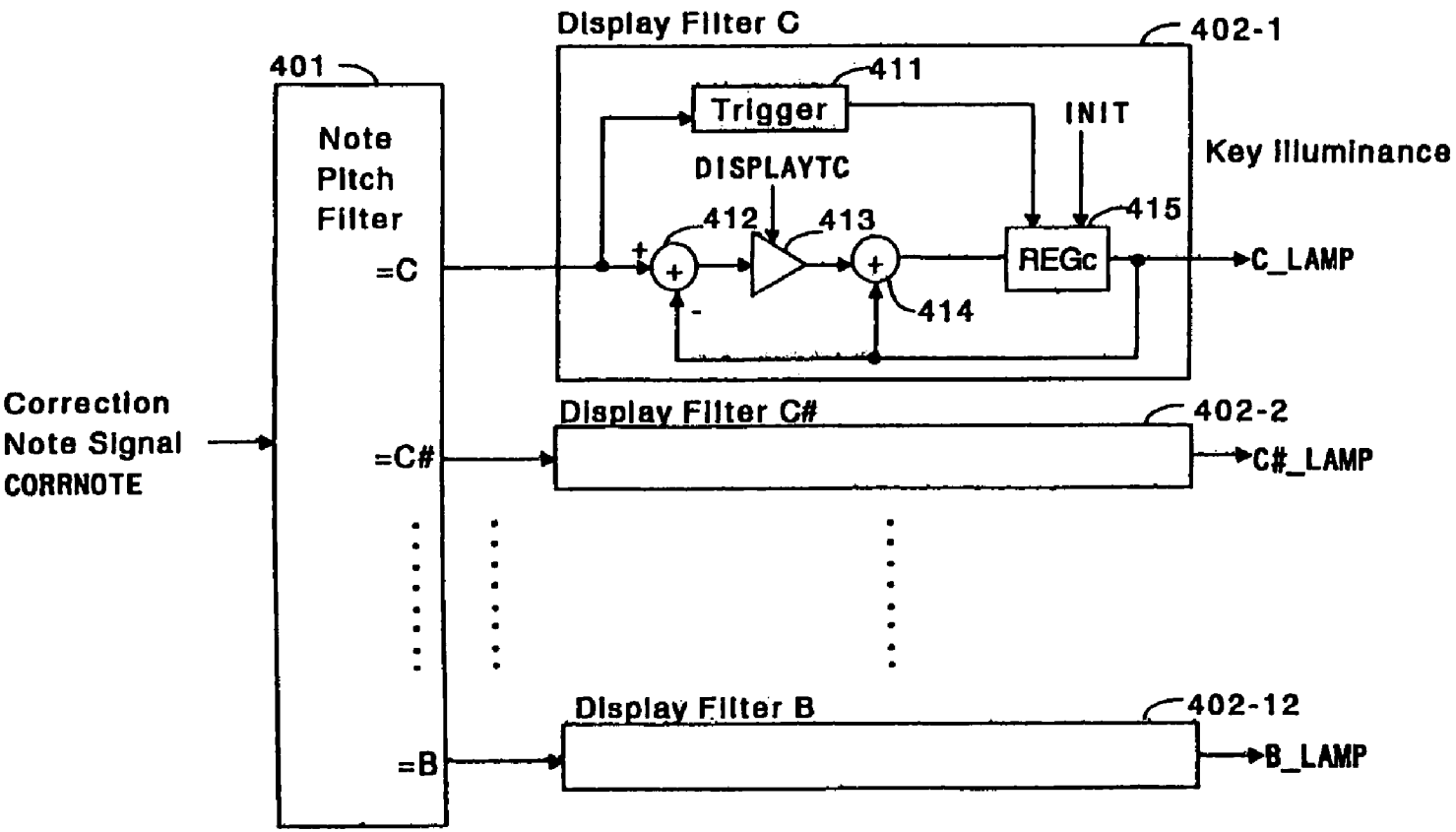

*Fig. 5* Variation in Key Illuminance
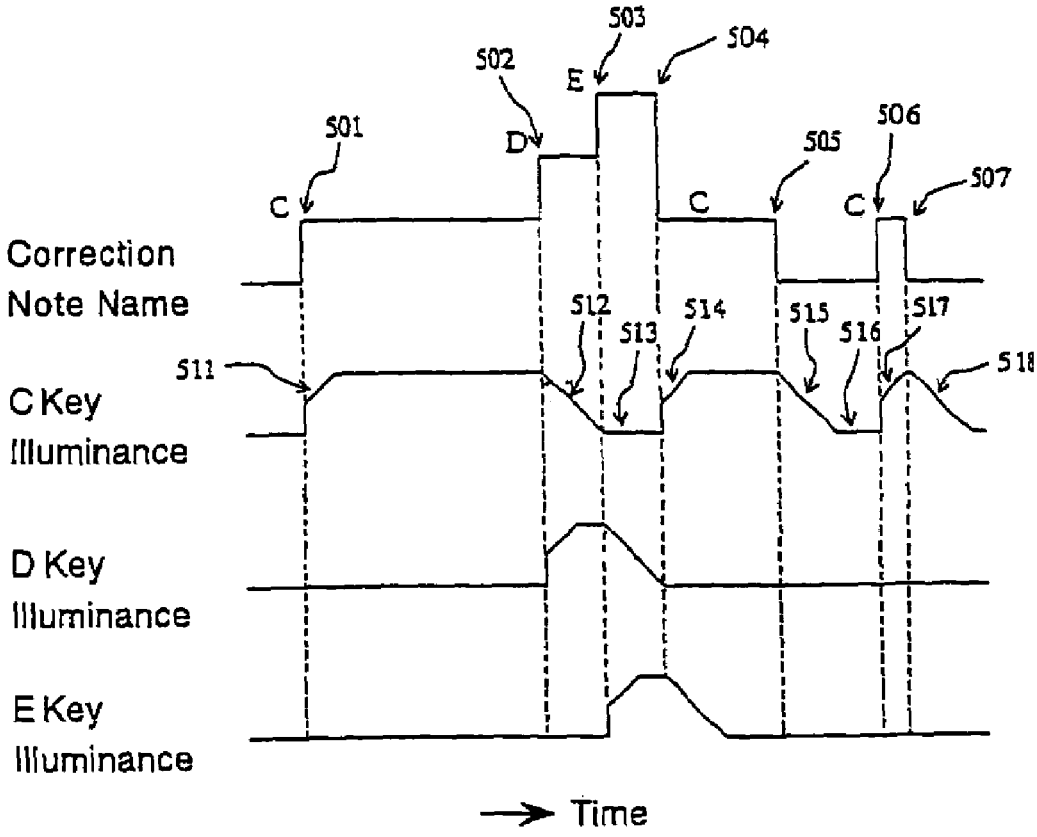

*Fig. 6* Pitch Correction Processing
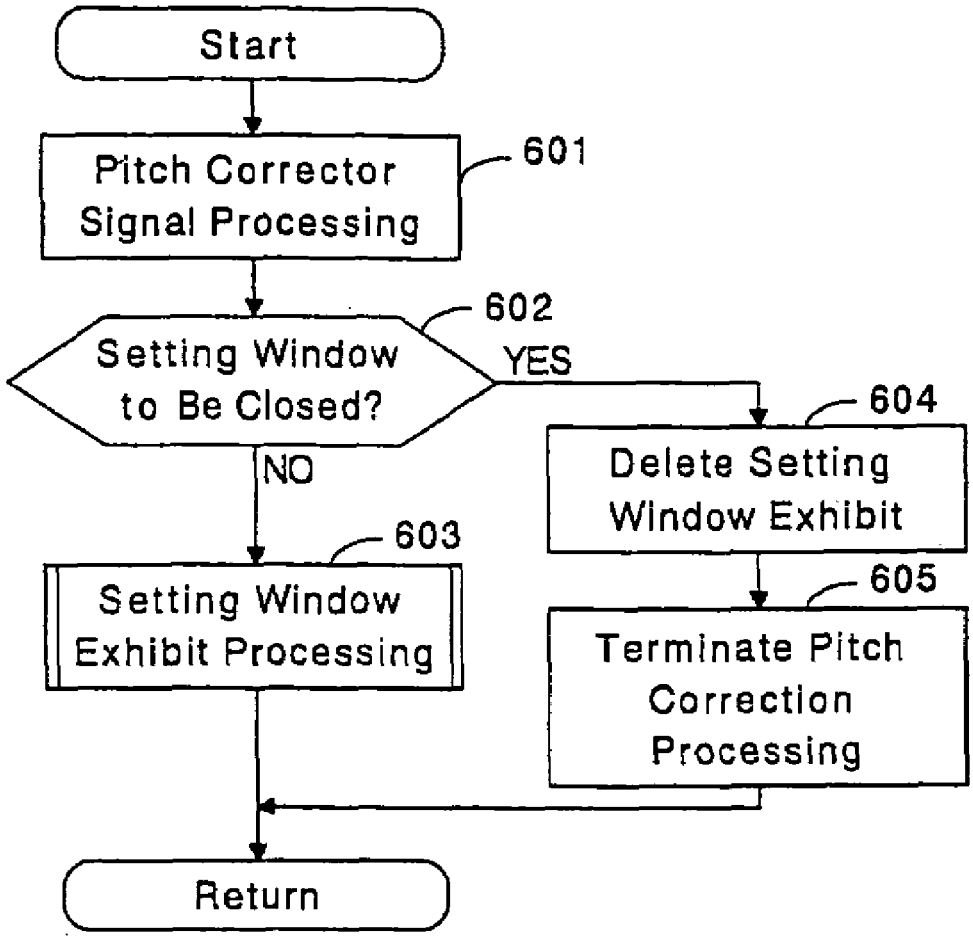

*Fig. 7a* Setting Window Exhibit Processing (Part 1)
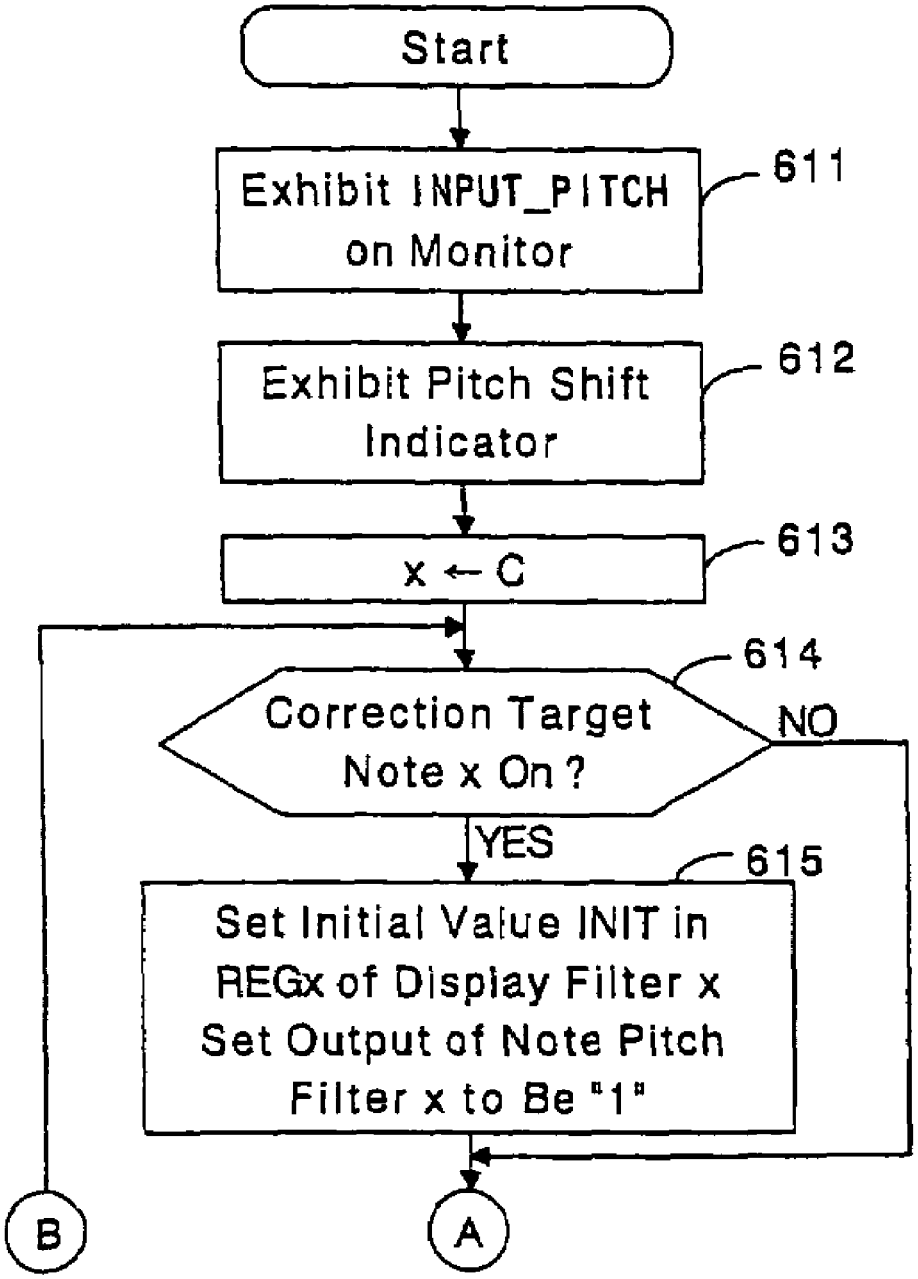

*Fig. 7b* Setting Window Exhibit Processing (Part 2)
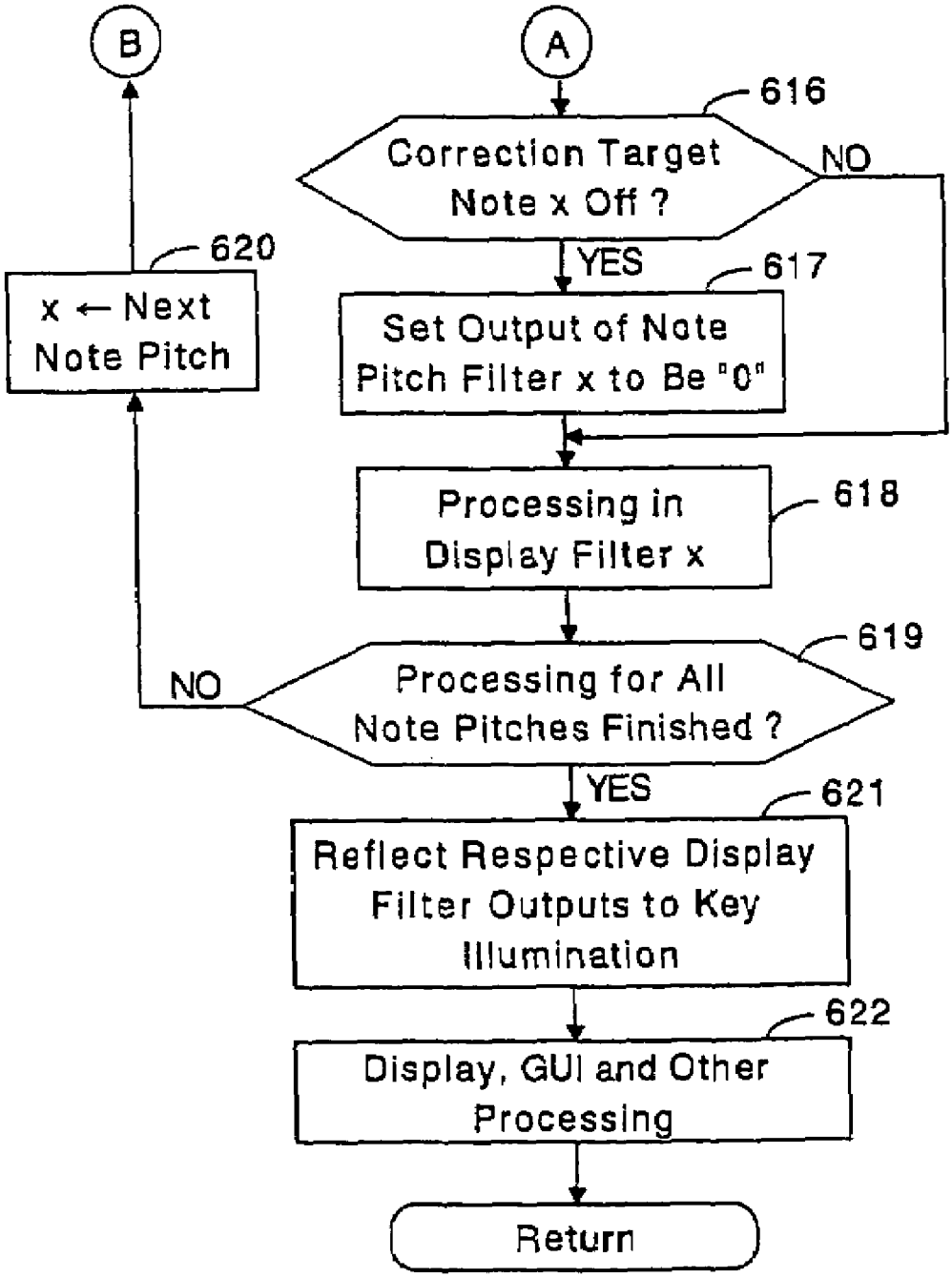

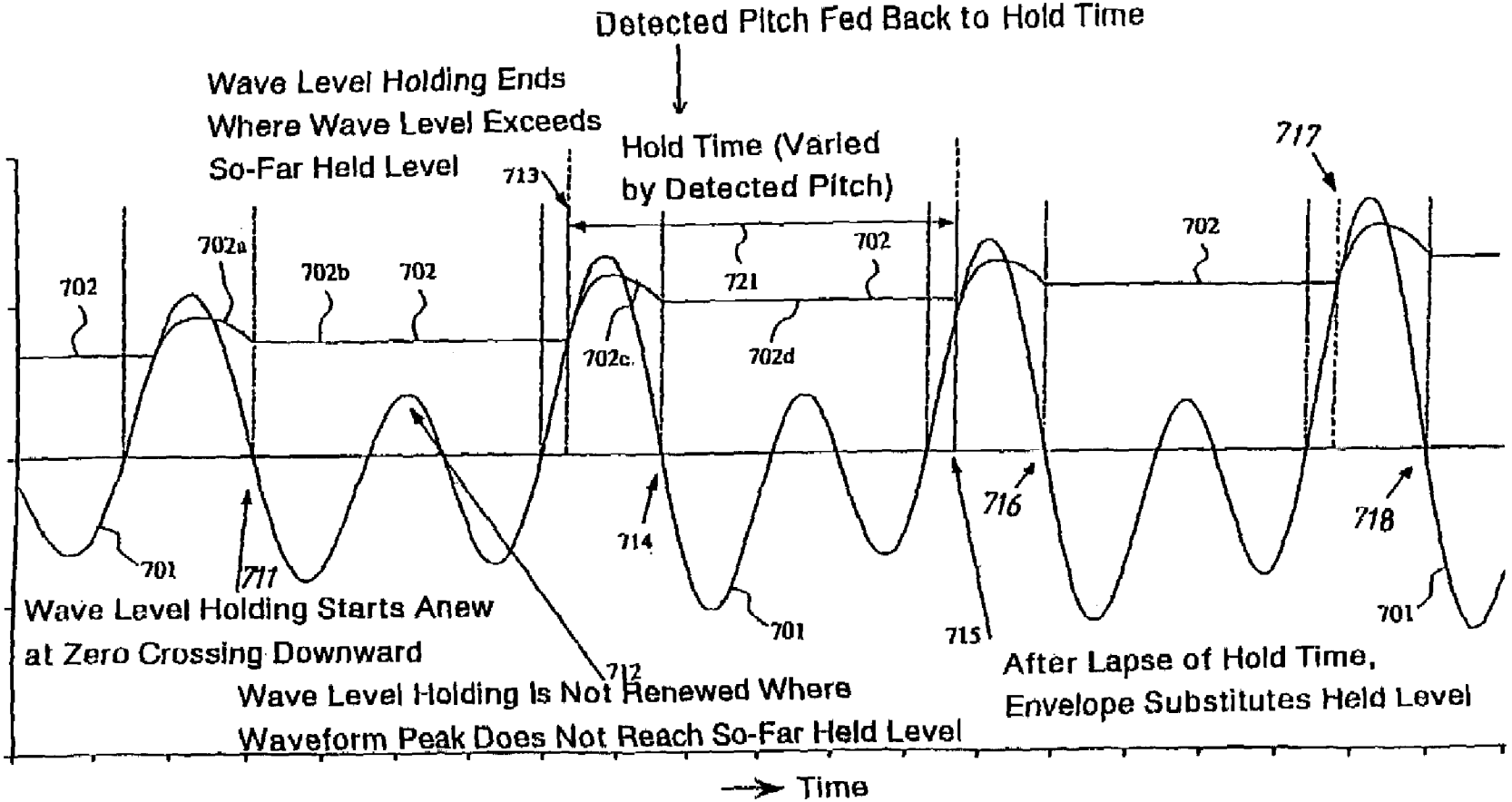
*Fig. 8* Pitch Detecting Operation

*Fig. 9* Pitch Detecting Operation without Holding Procedure
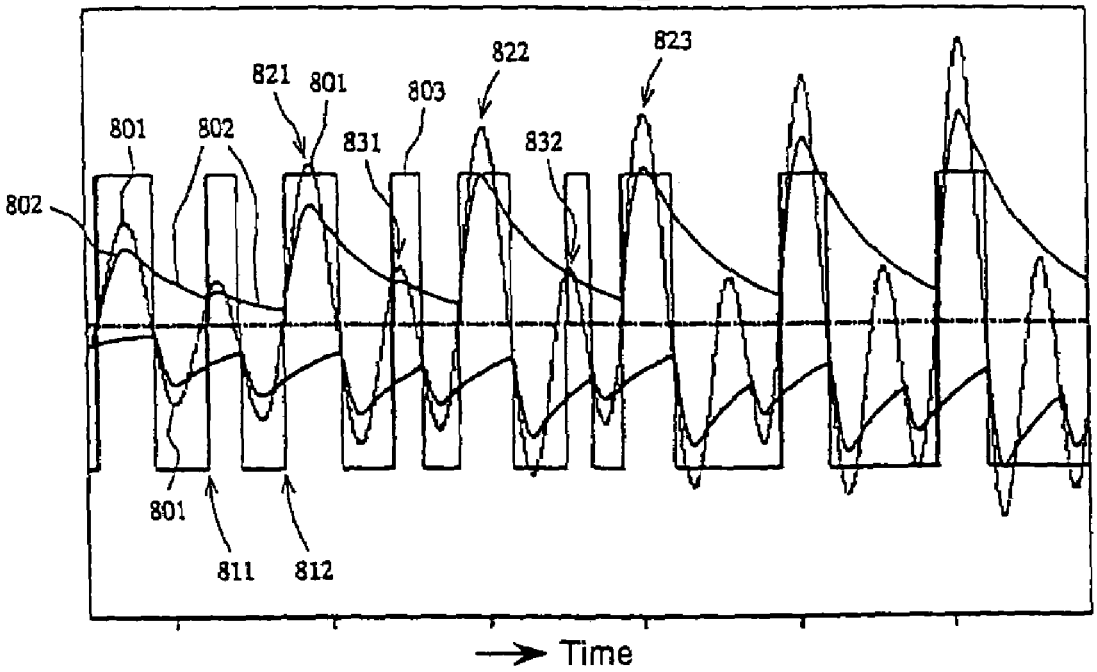
*Fig. 10* Pitch Detecting Operation with Holding Procedure
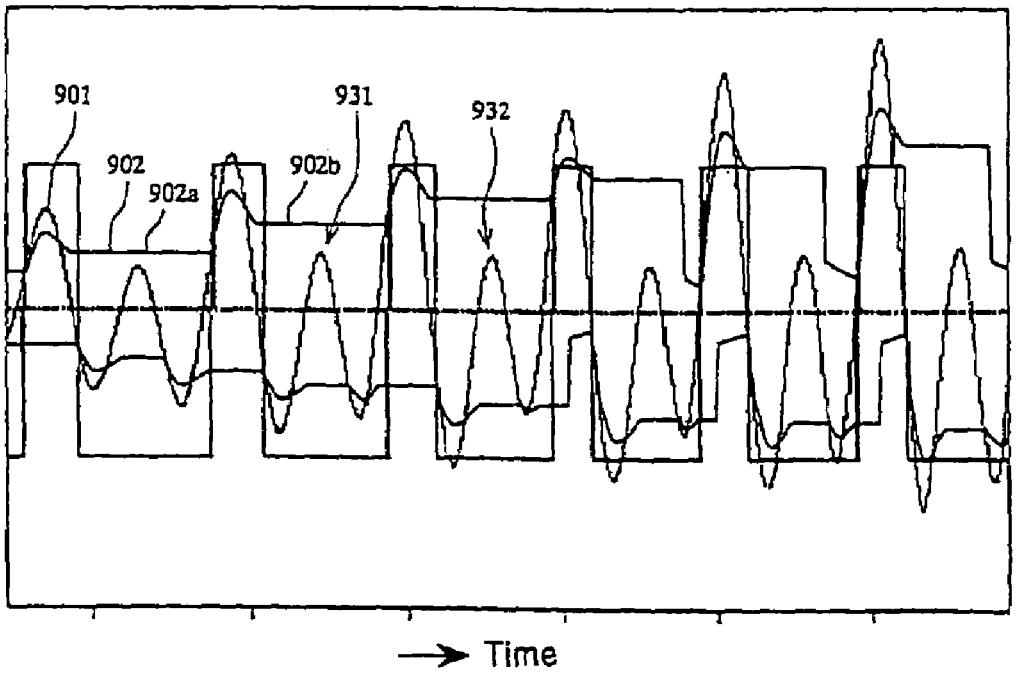

*Fig. 11* Pitch Detector Unit
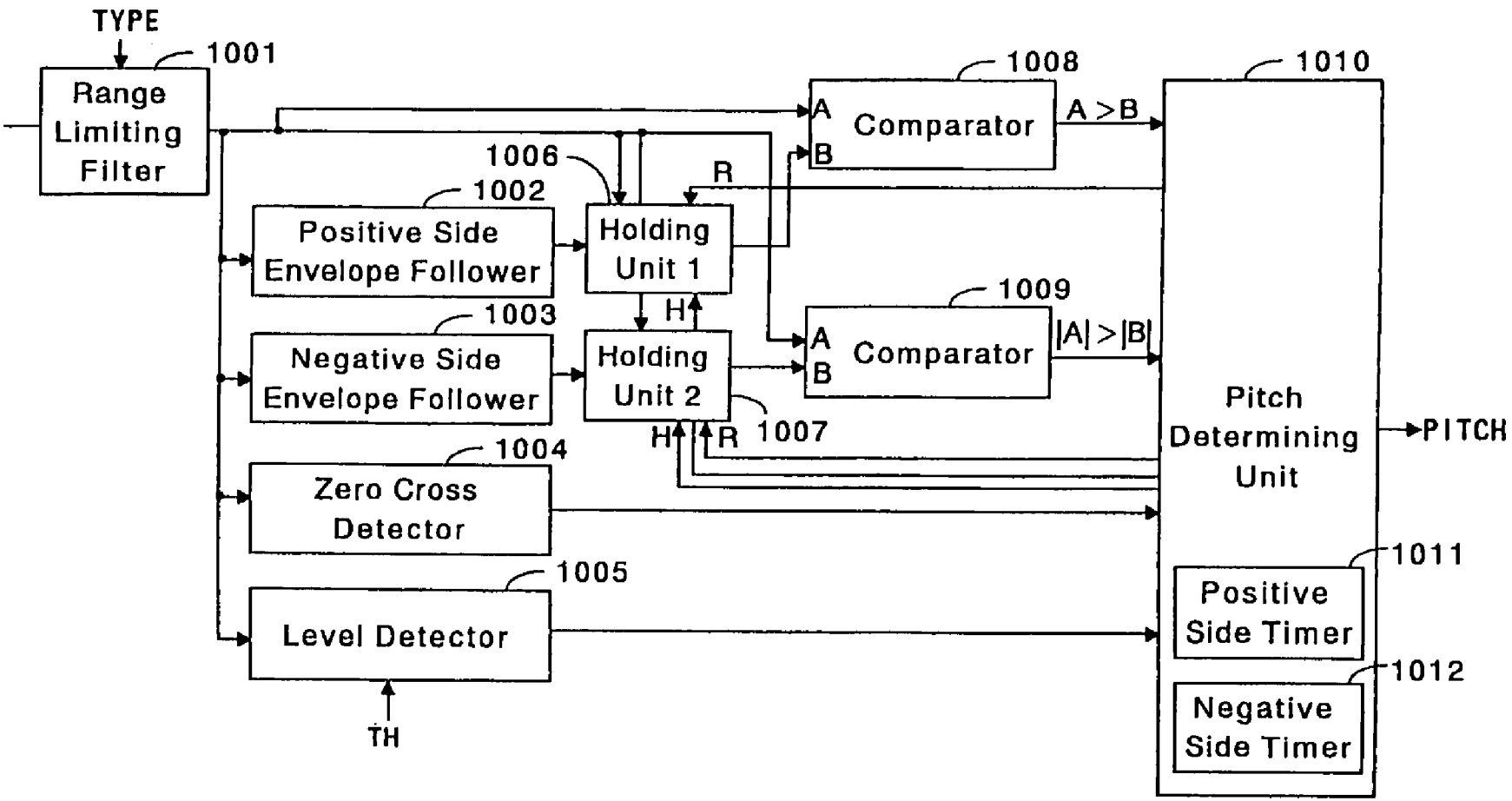

*Fig. 12* Envelope Follower
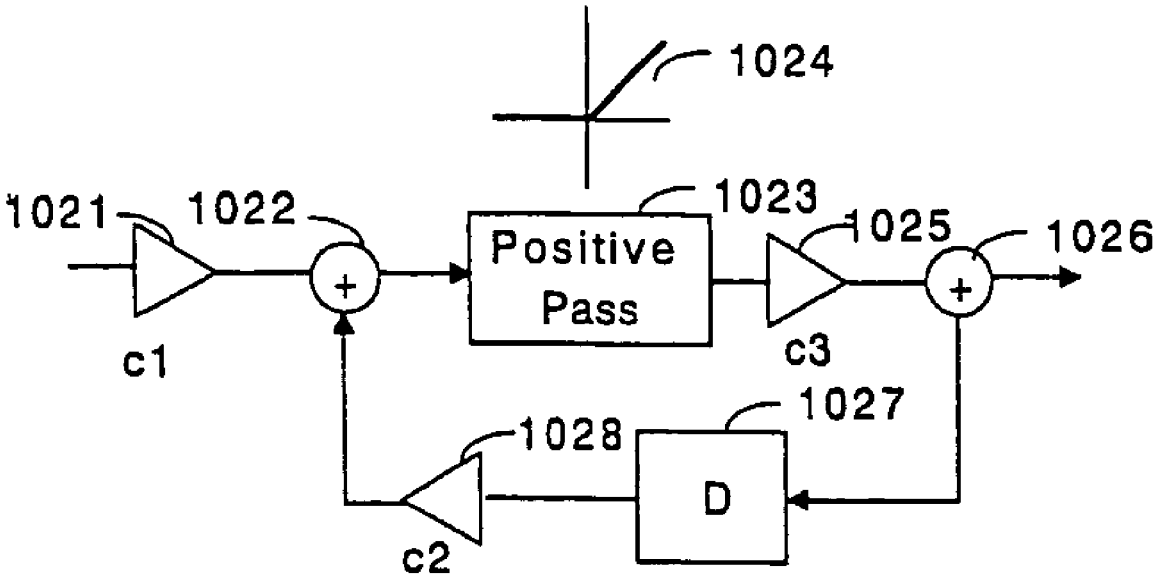

*Fig. 13a* Pitch Detection Processing (Part 1)
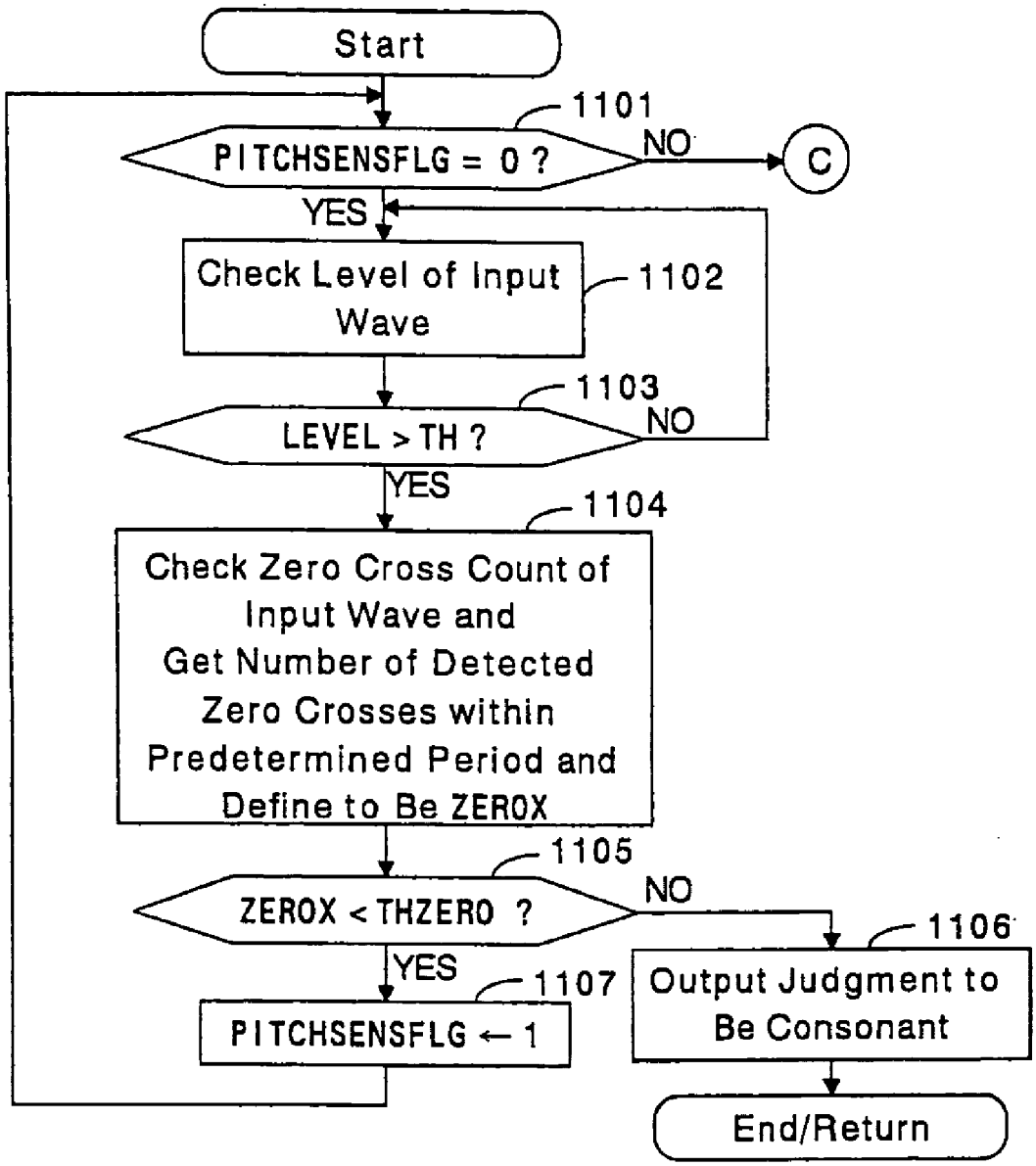

*Fig. 13b* Pitch Detection Processing (Part 2)
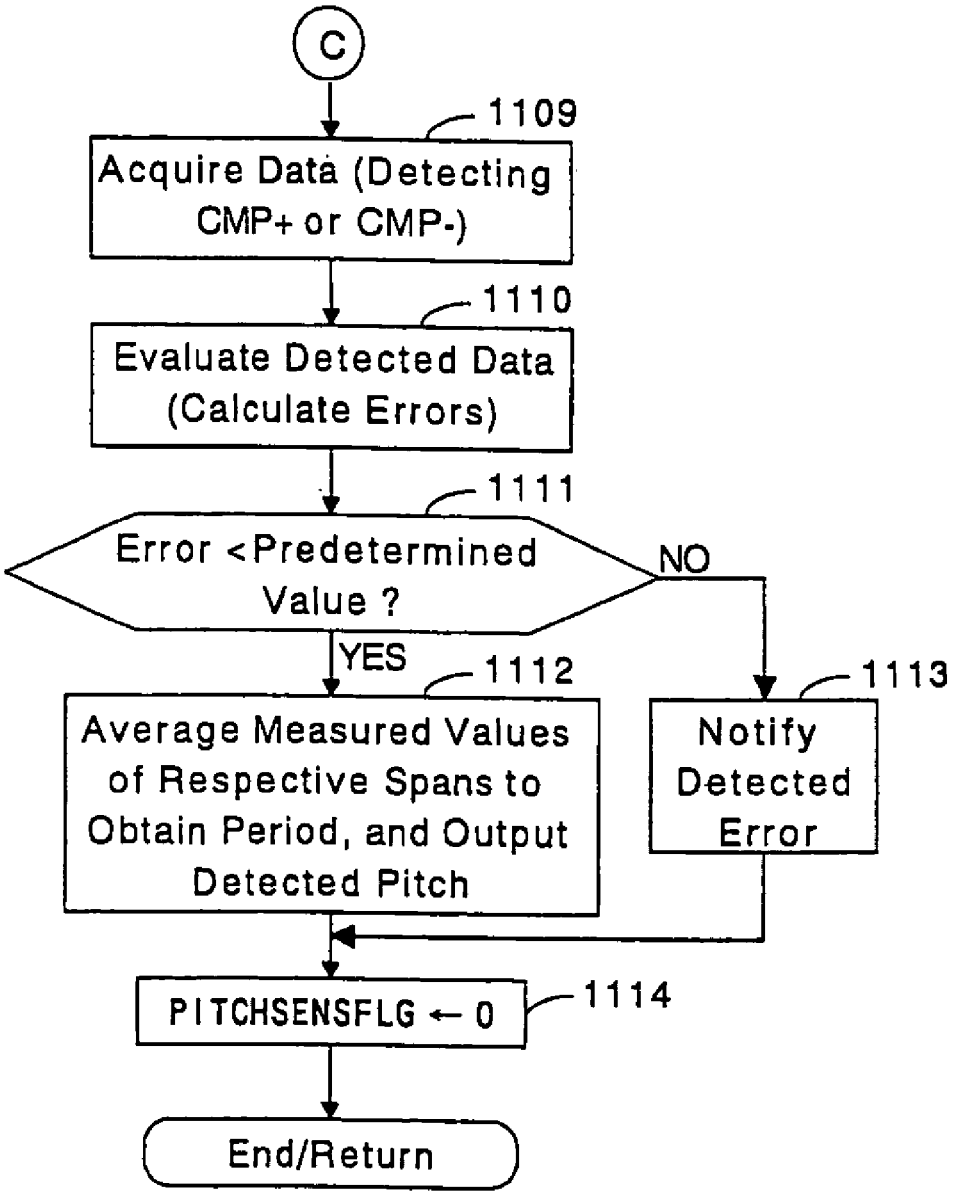

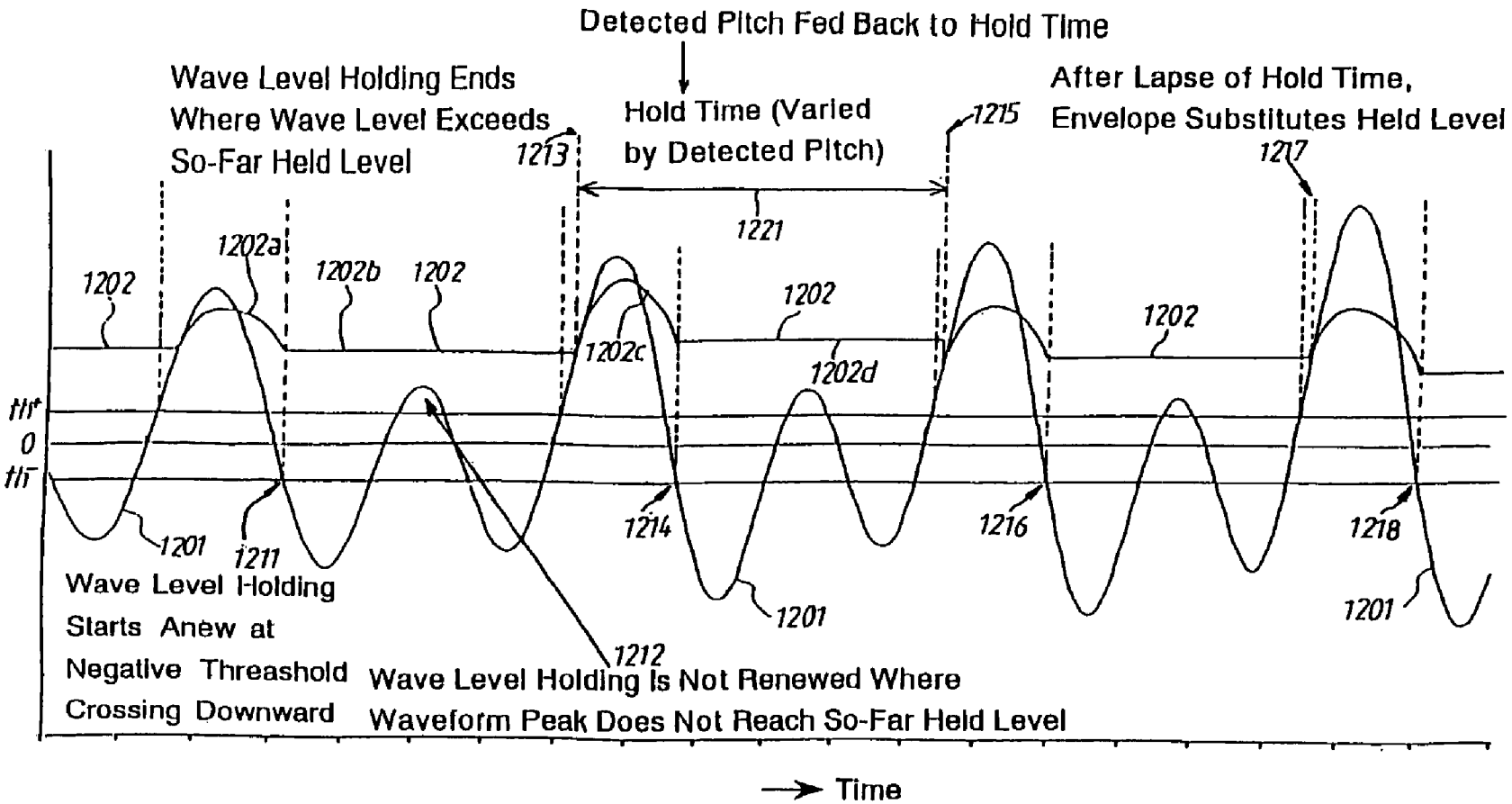
*Fig. 14* Pitch Detecting Operation

APPARATUS AND COMPUTER PROGRAM FOR DETECTING AND CORRECTING TONE PITCHES

CROSS-REFERENCE TO RELATED APPLICATIONS

This application claims the benefit of Japanese Patent Application 2003-116656 filed Apr. 22, 2003 and Japanese Patent Application 2003-366166 filed Oct. 27, 2003. The disclosure(s) of the above application(s) is (are) incorporated herein by reference.

FIELD OF THE INVENTION

The present invention relates to an apparatus and a computer program for detecting and correcting tone pitches, and more particularly to an apparatus and a computer program for detecting the pitches of given tone waveforms such as musical instrument voices and human singing voices, and also for correcting the pitches of such given tone waveforms based on the detected tone pitches.

BACKGROUND OF THE INVENTION

An apparatus which corrects tone pitches of a given tone waveform is known in the art such as a pitch corrector or a pitch changer which corrects the tone pitches of a given tone waveform to arbitrarily designated note pitches (i.e. tone frequencies) in a musical scale. See, for example, unexamined Japanese patent publication No. H1O-78791 (now issued U.S. Pat. No. 3,379,348). Such an apparatus is used mainly for correcting unstable or incorrect musical instrument tones or singer's voices fluctuating or deviating in tone pitch to produce a refined musical performance. For example, the apparatus may be used to adjust the singer's vocal tone pitches to the correct pitches of the accompaniment at a karaoke place. Or alternatively, the apparatus may be used to emphasize the characteristic features of the performed tones or voices by intentionally fluctuating or deviating the pitches in order to highlight the performers performance. A pitch corrector is capable of processing musical tone wave signals in real time. Some devices are provided in the form of a function expanding plug-in software for an automatic music performing apparatus. For example, a pitch corrector may be useful in the case of recording vocal tones (i.e. human voices of a singer) accompanied by an automatic musical performance so that the pitches of the vocal tones should be corrected to the predetermined melody note pitches (or to the accurate note pitches in the predetermined musical scale) to realize voices singing in accurate note pitches to match the accompaniment.

Such an apparatus or software product like a pitch corrector or pitch changer for correcting the pitches of the given tone waveform should have a function of detecting the note pitches of the given or inputted tone waveform. A typical pitch detecting procedure is to form an envelop waveform from the given tone waveform data, to detect the zero crossing points (the points where the wave shape crosses the zero level from a positive area to a negative area or from a negative area to a positive area) of the envelope waveform, and then to recognize the period (time span) between each adjacent zero cross points to determine the period of the given tone waveform.

A conventionally known pitch correcting apparatus or software product, however, did not include a device for visually recognizing how each tone pitch was corrected, and so forth. Further, a conventional apparatus which forms an envelope waveform of the input tone waveform and merely measures periods (time span) between respective zero cross points would inevitably involve errors due to noise vibrations or higher harmonics vibrations contained in the input tone waveform in the vicinity of the zero level.

SUMMARY OF THE INVENTION

It is, therefore, a primary object of the present invention to solve the drawbacks with the conventional apparatus and software product, and to provide a novel type of apparatus and computer program for detecting and correcting tone pitches, in which the pitches of the given musical tone waveform can be detected with minimal errors even in the case where the input tone waveform contains noise components or higher harmonic vibration components in the vicinity of the zero level line, and further the manner (i.e. by what amount and in which direction) of the pitch correction can be readily recognized visually by the user.

According to the present invention, the object is accomplished by providing an apparatus for detecting tone pitches of a given tone waveform comprising: an envelope forming device which forms an envelope waveform of the given tone waveform; a zero cross time notifying device which notifies zero cross times of the given tone waveform; an envelope level holding device which holds the level of the envelope waveform at each of the notified zero cross times; a hold release device which releases the level of the envelope waveform held by the envelope level holding device, every time the level of the given tone waveform exceeds the level of the envelope waveform held by the envelope holding device; a pitch determining device which determines the pitch of the given tone waveform based on the times of such releasing.

According to the present invention, the object is further accomplished by providing a computer program for detecting tone pitches of a given tone waveform containing program instructions executable by a computer, the program causing the computer to execute: an envelope forming step of forming an envelope waveform of the given tone waveform; a zero cross time notifying step of notifying zero cross times of the given tone waveform; an envelope level holding step of holding the level of the envelope waveform at each of the notified zero cross times; a hold release step of releasing the level of the envelope waveform held by the envelope level holding step, every time the level of the given waveform exceeds the level of the envelope waveform held by the envelope holding device; a pitch determining step of determining the pitch of the given tone waveform based on the times of such releasing.

The similar signal processing may be conducted separately in both the positive swing side and the negative swing side of the given tone waveform involving a positive side envelope waveform and a negative side envelope waveform. The pitch may preferably be determined by averaging several periods between the adjacent zero cross times. Further, errors among detected periods may preferably be taken so that the detected periods having an unusual error value should be omitted from determining the tone pitch.

According to the present invention, the object is still further accomplished by providing an apparatus for correcting tone pitches of a tone waveform comprising: a pitch detecting device which detects a tone pitch of the given tone waveform; a correction target note pitch providing device which provides a correction target note pitch to which the tone pitch of the given tone waveform is to be corrected; a pitch correcting device which corrects the detected tone pitch of the given tone waveform to the correction target note pitch; a correction target note exhibiting device which exhibits the correction target note pitch; and a pitch correction exhibiting device which exhibits the conditions of the pitch correction by the pitch correcting device.

According to the present invention, the object is still further accomplished by providing a computer program for correcting tone pitches of a given tone waveform containing program instructions executable by a computer which is connected to a display device, the program causing the computer to execute: a pitch detecting step of detecting a tone pitch of a given tone waveform; a correction target note pitch providing step of providing a correction target note pitch to which the tone pitch of the given tone waveform is to be corrected; a pitch correcting step of correcting the detected tone pitch of the given tone waveform to the correction target note pitch; a correction target note exhibiting step of exhibiting the correction target note pitch on the display device; and a pitch correction exhibiting step of exhibiting the conditions of the pitch correction by the pitch correcting step.

In an aspect of the present invention, the conditions of the pitch correction are exhibited by exhibiting the detected tone pitch of the given tone waveform and an amount of pitch correction as corrected by the pitch correction from the detected tone pitch of the given tone waveform.

In a further aspect of the present invention, the correction target note pitch is indicated by lighting an indicator element correspondingly provided for each of respective note pitches, the indicator increasing its illuminance gradually to a maximum illuminance with a predetermined time constant to start lighting and decreasing its illuminance gradually to a minimum illuminance with a predetermined time constant to extinguish lighting. The indicator elements may be a picture image of a musical keyboard exhibited on a display device. Further, the indicator elements may be a hardware keyboard having keys with respectively installed lamps for indication, or may be another type of note indicating device capable of individually indicating note names or note pitches.

With an apparatus and a computer program for detecting tone pitches of a given tone waveform according to the present invention, an envelope waveform of a given tone waveform is formed, the level of the envelope waveform is held at every zero cross time of the given tone waveform crossing the zero level, the so held envelope waveform level is released when the level of the given tone waveform exceeds the held envelope waveform level, and the tone pitch is determined based on the period between the adjacent hold release times, and therefore, the noise components and the higher harmonic components contained in the given tone waveform will hardly influence the determination of the pitch. In addition, by avoiding errors found in the hold release times, the pitch of the given tone waveform will be detected with minimal errors.

With an apparatus and a computer program for correcting tone pitches of a given tone waveform according to the present invention, the correction target note pitch, the tone pitch of the given tone waveform and the amount of pitch correction are exhibited as an apparent visual presentation, and therefore, the user can readily understand how the pitch correction is going on.

As will be apparent from the description herein later, some of the structural element devices of the present invention are structured by means of a hardware circuits, while some are configured by a computer system performing the assigned functions according to the associated programs. The former may of course be configured by a computer system and the latter may of course be hardware structured discrete devices. Therefore, a hardware-structured device performing a certain function and a computer-configured arrangement performing the same function should be considered a same-named device or an equivalent to each other.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

For a better understanding of the present invention, and to show how the same may be practiced and will work, reference will now be made, by way of example, to the accompanying drawings, in which:

FIG. 2 is a block diagram illustrating the functional configuration of an embodiment of an apparatus for correcting tone pitches according to the present invention.

FIGS. 3*a*–3*d* are charts respectively depicting examples of the exhibited setting window for the pitch corrector according to the present invention.

FIG. 4 is a block diagram illustrating the functional configuration of an embodiment of a key illumination control unit to be included in the pitch corrector according to the present invention.

FIG. 5 is a chart showing an example of operation timing indicating how the respective key illuminances vary in an embodiment of the present invention.

FIG. 6 is a flow chart describing the process steps for the pitch correction in an embodiment of the present invention.

FIGS. 7*a* and 7*b* are, in combination, a flow chart describing the process steps for exhibiting the setting window in an embodiment of the present invention.

FIG. 8 is a waveform chart describing how the pitch detection procedure is conducted in an embodiment of the present invention.

FIG. 9 is a waveform chart showing overall view of the signal waves occurring in the pitch detection operation wherein no envelope level holding process takes place.

FIG. 10 is a waveform chart showing overall view of the signal waves occurring in the pitch detection operation wherein an envelope level holding process takes place.

FIG. 11 is a block diagram illustrating an embodiment of the pitch detector unit according to the present invention.

FIG. 12 is a block diagram illustrating an embodiment of the positive side envelope follower to be included in the pitch detecting unit according to the present invention.

FIGS. 13*a* and 13*b* are, in combination, a flow chart describing the process steps of the pitch detection processing according to the present invention.

FIG. 14 is a waveform chart describing how the pitch detection procedure is conducted in another embodiment of the present invention.

DETAILED DESCRIPTION OF THE PREFERRED EMBODIMENTS

Figure 1:
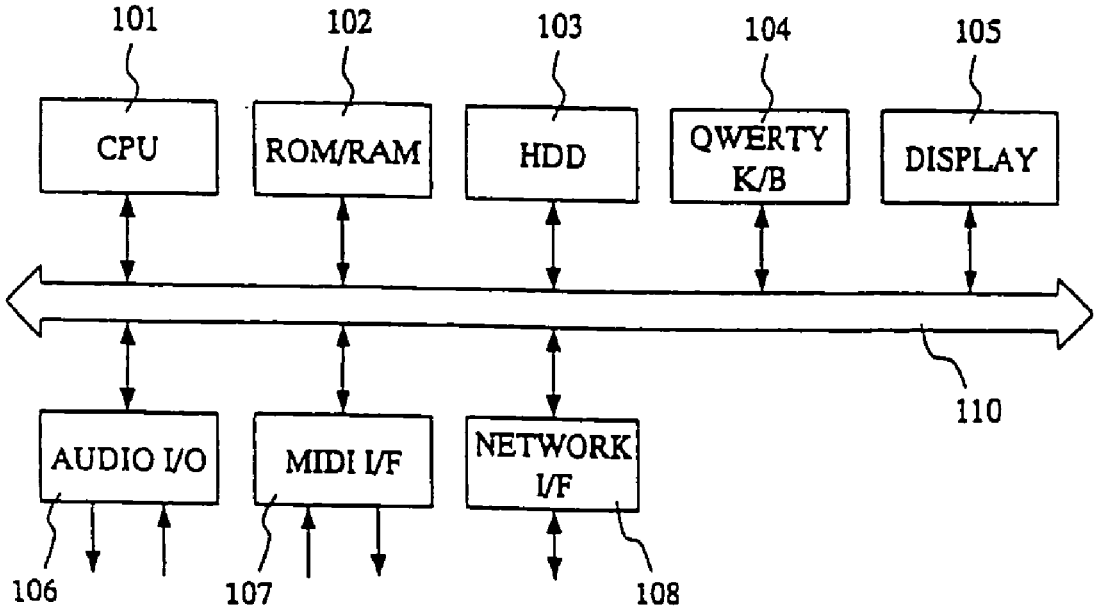
FIG. 1 is a block diagram illustrating the hardware configuration of an embodiment of an apparatus for correcting tone pitches according to the present invention.

The following description of the preferred embodiment(s) is merely exemplary in nature and is in no way intended to limit the invention, its application, or uses.

Herein below will be described an embodiment of the present invention with reference to accompanying drawings. FIG. 1 shows a block diagram illustrating the hardware configuration of an embodiment of an apparatus for correcting tone pitches according to the present invention. The pitch corrector comprises a CPU 101, a ROM/RAM 102, a hard disk drive (HDD) 103, an alphanumeric keyboard 104, a display device 105, an audio input/output interface 106, a MIDI interface 107, a network interface 108 and a bus line 110 interconnecting the enumerated devices.

The CPU 101 controls the overall operations of the pitch corrector of this embodiment. The ROM/RAM block 102 includes a nonvolatile read-only memory (ROM) and a volatile random-access memory (RAM) for storing programs executed by the CPU 101 and data processed by the CPU 101. The HDD 103 is an external storage device storing various programs and data used by the CPU 101. The alphanumeric keyboard 104 is, for example, a QWERTY keyboard as used for typing on an ordinary personal computer. The display 105 exhibits various information based on the instructions from the CPU 101. The audio input/output interface 106 is an interface for inputting and outputting musical tone waveforms. The MIDI interface 107 is an interface for inputting and outputting MIDI signals. The network interface 108 is a communication interface for connecting this apparatus to a local area network (LAN) and Internet. The bus line 110 is a bus line for connecting these mentioned devices with each other.

The pitch corrector of this structure may be constructed as a dedicated apparatus for the exclusive use or may be configured using a general-purpose personal computer (PC) with associated programs. The embodiment will be described herein below as a pitch corrector configured by a general-purpose personal computer together with a PC application program or a plug-in function unit for an application program.

FIG. 2 shows a block diagram illustrating the functional configuration of an embodiment of the pitch corrector having the hardware structure of FIG. 1. The operations of the respective blocks or units in FIG. 2 are realized by running the associated software on the personal computer. Before describing the details of the processing at the respective blocks in FIG. 2, a description is now made with respect to the operational modes of this pitch corrector. There are three modes selectable in this pitch corrector: a MIDI-control-as-scale mode, a MIDI-control as-note mode and a panel mode.

The MIDI-control-as-scale mode is a mode in which a note name in a reference scale (of an octave) for correction is provided and the tone pitch of a given tone waveform is corrected to the pitch of the note name in the reference scale for correction of the octave which is closest to the given tone pitch. The reference scale consists of note names (within an octave) of correction target note pitches, i.e. C, C#, D, - - - , A#, B (twelve notes at maximum). The note name of the correction target note pitch may be provided in terms of a MIDI note number (key code) in real time. The note names in the reference scale for this purpose carry no octave distinction (identification) such as "3" and "4" contained in "C3" and "C4" but carry only note names within an octave to be recognized by note names C, C#, - - - , B alone. Upon receipt of a MIDI note-on event, the note name of the received MIDI note number is added in the reference scale for correction, and upon receipt of a MIDI note-off event, the note name of the received MIDI note number is deleted from the reference scale for correction.

The MIDI-control-as-note mode is a mode in which a note name of a reference note for correction is provided and the tone pitch of a given tone waveform is corrected to the pitch of the note name (with octave distinction). The reference note for correction is expressed in an absolute value in terms of a MIDI note number in real time and carries the octave identification discriminating, for example, "C4" from "C3" in the case of a "C" note in a scale, Upon receipt of a MIDI note-on event of a single note, the note name of the received MIDI note number is recognized as the reference note for correction itself, and receipt of a MIDI note-off event of a single note, the note name of the received MIDI note number is deleted from the reference notes for correction. When plural MIDI note-on events are received, the latest arrival will prevail (last come, highest priority).

The panel mode is a mode in which a note name in a reference scale (of an octave) for correction is designated by a key (i.e. tonality) and a scale (degree name) using a menu box. An arbitrary scale can be designated through some predetermined manipulation. When a note in a reference scale is designated under the panel mode, the tone pitch of the inputted tone waveform (input signal) is corrected to the pitch of the note name in the reference scale for correction of the octave which is closest to the inputted tone pitch.

A description will be then made in detail about the processing at the respective blocks in FIG. 2. The input signal INPUT is a given tone waveform to be subjected to the pitch correction. It is assumed here that the input signal is a vocal tone. The output signal OUTPUT is waveform data of the vocal tone corrected in pitch. The pitch corrector further outputs data for exhibiting other information, including input tone pitch exhibit data INPUT_PITCH 221, correction note exhibit data CORRNOTE 222 and correction amount exhibit data CORRECT 223. The input tone pitch exhibit data INPUT_PITCH is the data which represent the tone pitch (e.g. frequency value) as detected from the inputted tone waveform for exhibiting the detected tone pitch of the input signal on the display device. The correction note exhibit data CORRNOTE is the data which represent the correction target note pitch (in note name) for exhibiting the correction target note pitch on the display device. The correction amount exhibit data CORRECT is the data which represent the amount of the pitch correction (shift amount) for the currently inputted tone signal for exhibiting the amount of the pitch correction on the display device.

To a block 201 for detecting pitch is inputted a parameter Type, which is a parameter for selecting the filter and pitch detection type which will fit the nature of the inputted tone waveform. Specifically, it is one of three categories, normal, male voice and female voice. The block 201 detects the tone pitch (e.g. frequency value) of the inputted tone waveform using a filtering and pitch detecting method according to the parameter Type. The detected tone pitch data is inputted to an adder 202. The adder 202 subtracts a reference frequency MasterTune(IN) from the detected tone pitch data. The data MasterTune(IN) is a parameter of setting a reference frequency for the tone pitch of the inputted vocal tone waveform. The default value is A4=440 Hz. The resultant note pitch data after the subtraction of the reference frequency is inputted to the block 203 for averaging. The averaging block 203 is to exert low-pass filtering (LPF) to avoid instantaneous variation in tone pitch of the input tone signal. A parameter PitchDetectSens is a parameter for setting a responsiveness (time constant) of the averaging processing 203. This parameter is set at an adequate value mainly in accordance with the magnitude of the pitch variation of the input tone signal. The vocal tone signal as inputted here will often have some noticeable pitch fluctuation according to the way of the singer, and consequently the pitch correction with too quick responsiveness might deteriorate the inherent nature of the vocal tone. To avoid such a demerit, the parameter PitchDetectSens may be adjusted to be a less sensitive responsiveness. A block 204 for determining a correction note is to conduct processing of determining, for the averaged detected pitch data, a correction target note having the designated reference scale name for correction in the octave closest to the averaged detected pitch data. Especially under the MIDI-control-as-scale mode, the block 204 of determining a correction note adds, upon receipt of a MIDI note-on event, the note pitch of the received MIDI note number is added in the reference scale for correction, and delete, upon receipt of a MIDI note-off event, the note pitch of the received MIDI note number from the reference scale for correction. Under the panel mode operation, the block 204 for determining correction note receives the parameters Key and Scale and determines the reference scale for correction.

A switch 205 is to be switched according to the designated operational mode. For the MIDI-control-as-scale mode or for the panel mode, the switch 205 is thrown to the side 205A so that the correction target note data including the octave identification as determined by the correction note determining block 204 is supplied to a block 206 for limiting the pitch. On the other hand, for the MIDI-control-as-note mode, the switch 205 is thrown to the side 205B so that the correction target note data of the reference note for correction as inputted from outside in real time is supplied to the block 206 for limiting the pitch.

The pitch limiting block 206 is for the processing of confirming whether the correction target note data falls within the range between the predetermined lower limit and higher limit. A parameter LowLimit and a parameter HighLimit are data respectively indicating the lower limit value and the higher limit value. When the correction target note pitch becomes lower than the lower limit value, the correction target note pitch is replaced by the lower limit value, and when the correction target note pitch becomes higher than the higher limit value, the correction target note is replaced by the higher limit value. The correction target note pitch data from the pitch limiting block 206 is outputted from the corrector as a correction note exhibit data CORRNOTE 222 representing the note pitch of the pitch correction target to be exhibited on the display device. The pitch limiting processing 206 converts the correction target note pitch to the frequency value and supplies this value to an adder 207 as a correction note pitch data (in frequency).

The adder 207 subtract the note pitch (in frequency) of the detected tone pitch of the input signal from the correction note pitch data (in frequency), and the resultant data (i.e. the difference between the tone pitch of the input tone and the note pitch of the correction target, which is the amount of pitch shift for correcting the tone pitch of the input tone) is inputted to a low-pass filter (LPF) 208. The LPF 208 is to smooth the change of the pitch shift amounts. A parameter PitchCorrectSpeed is a parameter for controlling time constant of the change from the time the pitch correction starts till the time the pitch correction reaches the correction target. The smoothed pitch shift amount as outputted from the LPF 208 is outputted from the corrector as the correction amount exhibit data CORRECT 223. To this pitch shift amount data is added a parameter PitchShift at an adder 209, and then a parameter MasterTune(OUT) at an adder 210. A PitchShift is a parameter for adjusting the general (or overall) pitch of the pitch corrected tone signal, and a MasterTune(OUT) is a parameter for setting the reference frequency of the tone pitches of the pitch corrected tone signal. The block 211 for shifting pitch is to shift the tone pitch of the input tone signal in accordance with the pitch shift amount data as outputted from the adder 210, and outputs the pitch corrected resultant tone signal as the output signal OUTPUT from the pitch corrector of FIG. 2. A FormantShift is a parameter for setting the frequency position of the formant as employed in the pitch shifting processing 211.

FIG. 3*a* depicts an example of the setting window for the pitch corrector as exhibited on the display screen. The setting window is exhibited on the display screen when the pitch corrector is in operation as explained with reference to FIG. 2. A keyboard panel 301 includes keys of an octave length for indicating the twelve notes from C through B within an octave scale. Above the keyboard panel 301, there is an indicator area 302 for exhibiting the conditions of the pitch correction. Also included in the setting window are control buttons 303 for adjusting or altering various parameters as explained with reference to FIG. 2. A detailed description of the control buttons 303 is omitted here.

FIG. 3*b* shows an example of how the indicator area 302 exhibits the conditions of the pitch correction. A T-shaped mark 311 is a detected tone pitch indicator mark which indicates the tone pitch as detected from the current input tone signal, based on the input tone pitch exhibit data INPUT_PITCH in FIG. 2, on the monitor screen. The positions for the detected pitch indicator mark 311 are provided in correspondence to the respective keys in the lower adjacent keyboard panel 301. For example, in FIG. 3*b*, the detected pitch indicator mark 311 is positioned just above the C# key, and this means that the tone pitch detected from the input tone signal is C#. However, as the input tone pitch exhibit data INPUT_PITCH represents a frequency value as described with reference to FIG. 2, the apparatus includes a processor for converting the frequency values into the note names (C, C#, D, - - - , A#, B) in an octave scale, and then exhibiting the detected tone pitch indicator mark 311 at the position which corresponds to the key of the same scale name.

A pitch shift indicator mark 312 indicates the amount of the current tone pitch correction (i.e. the correction amount exhibit data CORRECT in FIG. 2) from the input tone signal. The pitch shift indicator mark 312 represents the amount of pitch correction by the number of lighted LED's (constituting a horizontal lit length) from the detected tone pitch indicator mark 311. The data CORRECT assumes either positive or negative sign, which determines the side to be lit with the LED's for the pitch shift indication by the mark 312. FIG. 3*b* shows the state where the detected tone pitch of the current input tone signal is C# and the tone pitch is corrected up to the vicinity of the F note, While the correction target note is expressed in frequency, the correction is carried out gradually so that the mark 312 may fall on a position between the adjacent keys. In place of the indication by LED images, the amount of the pitch shift may be shown in a continuous horizontal bar. As the amount of pitch correction is greater, the indicator length is longer, while as the amount of pitch correction is smaller, the indicator length is shorter. When the amount of pitch correction is zero, there will be no lit length 312. When the pitch correction goes beyond the C note (to the left) or the B note (to the right), the pitch shift indicator mark 312 is to skip to the opposite ends to further increase the length. FIG. 3*c* shows the case in which the detected tone pitch is G4 as indicated by the detected tone pitch indicator mark 322 and the correction target note pitch is C5 beyond the right most key B4, with the portions 323 and 324 are lit.

FIG. 3*d* is to show an example of indicating a correction target note pitch on the keyboard panel 301. The correction target note is indicated by lighting a part of the corresponding key on the keyboard panel 301 based on the correction note exhibit data CORRNOTE. The correction target note pitch varies moment by moment according to the input tone signal, and the keys of the correction target notes are lit in real time. With respect to the key of the correction target note, the illuminance of the lighted key is creased rapidly when the correction note exhibit data CORRNOTE is supplied anew to the key and reaches its maximum illuminance in a predetermined time lapse, and keeps its maximum illuminance as long as the correction note exhibit data CORRNOTE of the same correction target note name is supplied. When the correction note exhibit data CORRNOTE representing another new correction target note or NULL data (meaning no correction target note) is outputted from the pitch corrector, the key which has been lit up until then will be extinguished. The extinction is conducted gradually with a slow decay so that the visibility by the user will be secured. In FIG. 3*d*, the key 331 shows an example with the maximum illuminance, the key 332 an example with less illuminance than the maximum, and the key 333 an example with a further extinguished state.

FIG. 4 shows a block diagram illustrating the functional configuration of an embodiment of a key illumination control unit which exhibits the correction target note names on the keyboard panel 301 as shown in FIGS. 3*a*–3*d*. In the present embodiment, the operations of the functional blocks are conducted by the associated programs rather than by dedicated hardware circuits.

The key illuminance control unit of FIG. 4 includes a note pitch filter 401 and display filters x (x: C through B) 402-1 through 402-12 for controlling key illuminances of the individual keys. The note pitch filter 401 receives the input of the correction note exhibit signal CORRNOTE from the pitch corrector of FIG. 2, and outputs a value "1" at the output line assigned to the note name as represented by the correction note exhibit signal CORRNOTE and values "0" at the output lines assigned to the other note names than such a represented note name. When the correction note exhibit data CORRNOTE assumes the NULL data, all the output lines output a value "0." For example, as the correction note exhibit data CORRNOTE represents the note name of "C," the output from the line "=C" of the note pitch filter 401 turns from "0" to "1." At this time, the display filter C (402-1) functions and operates to control the illuminance of the key of "C" as follows.

The output of the Trigger 411 becomes "1," which in turn drives the register REGc 415 to capture the initial value INIT (where INIT <1). Thus, the output C_LAMP of the display filter 402-1 turns from "0" to the initial value INIT. The key of C is illuminated with the illuminance according to the output C_LAMP in the manner as explained with reference to FIG. 3*d*. The initial illuminance is determined by the value of INIT which is less than "1." An adder 412, a multiplier 413, an adder 414, and the register 415 as a delay element constitute a filter which outputs an output value which starts with the present value and approaches the inputted value. The time constant is determined by a parameter DISPLAYTC. If the correction note exhibit data CORRNOTE continues the note name C, the display filter 402-1 continuously receives the input "1" and the illuminance of the key of C increases gradually up to the maximum illuminance. After the illuminance reaches the maximum value, the maximum illuminance is kept still as long as the note name C continues. When the correction note exhibit data CORRNOTE is changed to another note name (than C), the output at the line "=C" of the note pitch filter 401 turns from "1" to "0," and the value "0" is inputted to the display filter 402-1, and the value REGc in the register 415, i.e. the value C_CLAMP gradually decreases from "1" to "0." Thus, the illuminance of the key C decreases from "1" to "0."

Other display filters 402-2 through 402-12 (for C# through B) are of the same structure, and each of them outputs the key illuminance signal (C#_LAMP, - - -, B) for the assigned note name so that the key in the keyboard panel 301 is illuminated in the similar manner as explained with respect to the key of C above. Seven or eight grades may be enough for the degrees of the key illuminance practically.

FIG. 5 is a timing chart showing an example of operations indicating how the respective key illuminances vary in the embodiment. The top line shows the variation in note name of the data CORRNOTE. The data starts with NULL and changes to the correction note name of C at the time of 501, thereafter continues the note name C, and changes to the correction note name of D at the time of 502. Thereafter, the data changes to E at the time 503, to C at the time 504, to NULL at the time 505, to C again at the time 506 and to NULL at the time 507.

The second line of FIG. 5 shows how the illuminance of the key of C varies when the data CORRNOTE varies as described by the top line of the timing chart. As the correction note becomes C at the time of 501, the illuminance value builds up to the initial value INIT and then gradually approaches the value "1" with a slope 511. After that the same illuminance "1" continues up to the time 502, when the note name changes to D, and then the illuminance of the key C decreases gradually as shown by the slope 512 to reach "0" level to keep "0" as shown by a horizontal line 513 until the next C note comes at the time 504. The illuminance value builds up to the initial value INIT and gradually approaches the value "1" with a slope 514. At the time 505, the correction note name becomes NULL, and accordingly the illuminance for the key C gradually decreases as shown by the decaying slope 515 to reach the zero line as shown by 516. The correction note data becomes C again at the time 506, and the illuminance value builds up to the initial value INIT and increases by the slope 517 as shown. As the note name C disappears on the way of increase at the time 507, the illuminance value decreases from that level to the zero level following a slope 518. The third line of FIG. 5 shows the variation in the illuminance of the key D in the similar manner. The fourth line of FIG. 5 shows the variation in the illuminance of the key E also in the similar manner.

As described above, where the inputted tone pitch varies without interruption therebetween or varies contiguously in a sufficiently short time, the illuminance of the key to be extinguished decreases gradually with some afterglow while the next key illumination starts as soon as the key is designated by the next data, thus the user can easily follow the changes in the correction target note pitches.

Where the key-on and the key-off (meaning the start and the end of the input tone waveform in this context) of the same tone pitch are repeated continuously, the illuminance may be controlled to decay rapidly (i.e. without a slow decay) so that the user can recognize the on events and the off events individually. For such a purpose, the parameter DISPLAYTC of the display filters may be varied according to the time span between the key-on event and the key-off event or the time span between the adjacent key-on events, or according to the number of key-on events or key-off events in a predetermined period of time. Also in the case of key-on and key-off repetition with the different tone pitches, a similar control as mentioned above may be utilized according to the way of variation in the key-on and the key-off events.

Further, the time constants for the build up and the decay of key illuminance may be changeable or selectable. The parameter DISPLAYCT of the display filter may be made arbitrarily alterable for the user on predetermined setting window. While the display filter of FIG. 4 uses the same time constant for the build-up time and the decay time of the illuminance, separate filters may be employed and separate time constant may be used for the build-up control and the decay control. In such a case, the time constant for the illuminance build-up may be alterable and controllable in accordance with the parameters PitchDetectSens and PitchCorrectSpeed in FIG. 2.

FIG. 6 shows a flow chart describing the process steps for the pitch correction in an embodiment of the present invention. This processing flow runs on a personal computer configured as shown in FIG. 1 under the control by the associated computer OS (operating system). A step 601 conducts the pitch corrector signal processing, which is conducted by the pitch corrector having the functional configuration of FIG. 2. A step 602 judges whether there is an event or command to close the setting window (FIG. 3). If the judgment turns out negative (NO), the process flow goes through a step 603 to execute the setting window exhibit processing and thereafter returns to the main routine. If the judgment turns out positive (YES), the process flow goes to a step 604 to delete the setting window exhibit, and thereafter to a step 605 to terminate the pitch correction processing before returning to the main routine, FIGS. 7*a* and 7*b* show, in combination, a flow chart describing the subroutine process steps of the step 603 of FIG. 6 for exhibiting the setting window. A step 611 is to conduct the process of exhibiting the input tone pitch on the monitor based on the input tone pitch exhibit data INPUT_PITCH 221 shown in FIG. 2. This process is to first obtain a note name (C, C#, - - -, B) from the data value (frequency) of the pitch INPUT_PITCH as detected from the input tone signal, and then to exhibit the detected tone pitch indicator mark 311, 322 (FIG. 3*a*, 3*b*). Next, in a step 612, the pitch shift indicator mark 312, 323, 324 is exhibited on the setting window based on the current correction amount exhibit data CORRECT 223 shown in FIG. 2.

Next, in a step 613, the note name C which is the first note in an octave scale is placed into a work register x. The content of the register x is herein called a "note x" for the sake of brevity. A step 614 judges whether there is an "on" event of the correction target note x, i.e. whether the data CORRNOTE is x. If the judgment is negative (NO), the process skips to a step 616 (FIG. 7*b*), and if the judgment is positive (YES), the process moves forward to a step 615. The step 615 sets an initial value INIT in the register REGx in the display filter x (i.e. one for the note x among the display filters 402-1 through 402-12 in FIG. 4), and sets the output of the note pitch filter 401 at the line for the note x to be "1." The step 616 judges whether there is an "off" event of the correction target note x, i.e. whether the data CORRNOTE is not x. If the judgment is negative (NO), the process skips to a step 618, and if the judgment is positive (YES), the process goes forward to a step 617. The step 617 sets the output of the note pitch filter 401 at the line for the note x to be "0." The step 618 conducts the processing in the display filter x as explained with reference to FIG. 4 before. A step 619 judges whether the processing has been over for all the note pitches (note names). If there is any note remaining yet to be processed, the process flow goes to a step 620 to set the next note pitch (note name) into the work register x before going back to the step 614 (FIG. 7*a*). When the processing for all the note pitches have been finished, a step 621 reflects the respective outputs C_LAMP, C#_LAMP, - - - , B_LAMP of all the display filters 402-1 through 402-12 to the illuminances of the respectively corresponding keys on the keyboard panel 301 (FIG. 3*d*). A step 622 conducts other associated processing such as display processing, GUI processing, and so forth before returning to the main routine.

The format of the data for expressing note pitches may be of any convenient type. The note pitches may be simply expressed in their frequencies using binary notations of the frequency values. However, more conveniently and preferably, the note pitches may be expressed in a logarithmic scale, such as logarithmic frequency values and cent values, so that the calculation processes will be simple in shifting pitches. The cent values are values measuring a semitone as 100 cents and an octave as 1200 cents, which system is widely employed in the field of musical engineering. In identifying any arbitrary pitches absolutely, some reference pitch is taken as the "0" cent point and all the pitches are expressed by the heights or distances from such a reference point. For example, if the orchestral pitch standard note A4=440 Hz is taken as the reference point at "0" cent, the one-octave higher note A5 (=880 Hz) is expressed as "+1200 cents" pitch, while the whole-tone lower note G4 (=392 Hz) is expressed as "−200 cents" pitch.

In order to express all the possible pitch handled in the system in positive values, a pitch which is lower than any possible pitches to be handled should be taken as the reference pitch for the "0" cent point. For example, the note A(−2) having a frequency of 6.875 Hz may be taken as the "0" cent pitch. Then, the six-octave higher note A4 will be at "+7200" cents, the middle C note C4 will be at "+6300" cents, the note C3 will be at "+5100" cents, and the note C5 will be at "+7500" cents. A semitone interval is "100" cents and an octave interval is "1200" cents. This format in the cent value expression is very convenient in understanding the pitches (positions) and the intervals (distances), and even in recognizing the note names. For example, where the A4 ="+7200," the data values "+0," "+1200," "+2400," "+3600," "+4800," "+6000," "+7200," "+8400," "+9600," - - - all represent A notes (in different octaves). And further, the data values "+300," "+1500," "+2700," "+3900," "+5100," "+6300," "+7500," - - - all represent C notes (in different octaves).

The use of the cent value format facilitates coping with the change in the standard pitch of performance. It is assumed here that all the pitch related data in the system are stored and handled on the basis of A4 =440 Hz. Then, if the inputted tones are those performed on the standard pitch of A4 =441 Hz, the difference between these frequencies is 3.9302 cents, and then the detected pitch can be simply offset by this amount before inputting to and after outputting from the system.

The data in the cent value format can be utilized in controlling the illuminances of the keys. For example, if the detected tone pitch is equal to the standard note pitch (in cents), the key illuminance is made maximum, and if the detected tone pitch is deviated from the standard note pitch (in cents), the key illuminance is decreased according to the amount of cent deviation.

While the above description is made with respect to the embodiment in which the signal processing in the pitch corrector and the processing for the keyboard exhibition according to the program running on the personal computer, any arbitrary unit or block may be realized by a hardware circuit or device. In place of the keyboard panel exhibition on the display screen as shown in FIGS. 3*a*–3*d*, a hardware keyboard incorporating indicator lamps in each of the keys may be employed for the purpose of the present invention, if further equipped with a pitch indicator unit such as 331–333 shown in FIGS. 3*b*–3*c*. Further, while in FIG. 3*d*, the correction target pitch is indicated on the keyboard panel 301, any type of indication which tells the note names or pitches in some way may be used in place of the keyboard image exhibition on the display screen.

Hereinbelow will be described an embodiment of the pitch detecting block 201 in the pitch corrector of FIG. 2.

FIG. 8 is a waveform chart describing how the pitch detection procedure is performed in the embodiment of the present invention. A waveform 701 is given tone waveform which is an input signal INPUT as inputted to the pitch detecting block 201 of FIG. 2. A waveform 702 is a combined waveform of positive side envelope waveform fractions 702*a*, 702*c* of the input tone waveform and held level fractions 702*b*, 702*d* of the positive side envelope waveform. Generally speaking, there are a positive side envelope and a negative side envelope of a given vibrational wave. Either envelope waveform of the given vibrational wave is a waveform which rapidly follows the outward (positively or negatively) swings of the given wave and slowly decays while the given wave swings inward, in other words, which does not rapidly follow the inward swings of the given vibrational wave, thus consequently tracing the either contour of the vibrational wave. The envelope waveform is formed by a circuit or an equivalent computer processing which follow the given waveform with a predetermined time constant and multiplication coefficient, and accordingly the envelope fractions 702*a*, 702*c* have a shape which vary with some delay from the wave shape of the original tone waveform 701 as observed in FIG. 8. More rapidly following envelope shapes may be used, of course. Note that FIG. 8 shows only the positive side envelope shape, while the negative side envelope shape is also formed and used in the embodiment.

The principle of the pitch detection of the present invention is described in detail with reference to FIG. 8. For the sake of simplicity, however, the procedure in the pitch detecting block 201 of FIG. 2 will be explained with respect to the positive side envelope processing in connection with the positive side swings of the given tone wave first. There are two kinds of envelope processing operations (a) and (b) defining two time spans. The operation (a) is observed in the time span of the first kind when the envelope wave shape is being formed from the swing shape of the original tone waveform, and the operation (b) is observed in the time span of the second kind when the same envelope wave level is being held. In the operation (a) during the time span of the first kind, a zero cross time from the positive side to the negative side (i.e. downward) of the original tone waveform is waited for and detected as it happens. And when it happens, the envelope wave level is held at this time, thereby ending this time span of the first kind and starting the time span of the second kind. For example, while the positive side envelope wave fraction 702*a* is being formed, the envelope wave level holding starts at the time 711 when the tone waveform 701 crosses the zero line from the positive side to the negative side. In the operation (b) during the time span of the second kind, the waveform level of the original tone waveform is compared with the above held positive side envelope wave level, waiting for the time at which the tone waveform exceeds the held envelope level. As long as the tone waveform does not exceed the held envelope level, the same wave level holding continues under the operation (b). For example, if the tone waveform peak 712 does not reach the so-far held level 702*b*, the wave level holding does not end, but is kept unchanged. But if the tone waveform 701 exceeds the so-far held envelope level 702*b* at the time 713, the wave level holding is released to end the operation (b) and the new envelope wave forming starts to go into the operation (a) again. At the time point 713, a timing detection flag CMP is set to be "1" (i.e. CMP=1). The timing detection flag CMP is the flag for measuring the time length to determine the pitch of the given tone waveform. The timing detection flag CMP is to assume either "1" or "−1" depending on the polarity of the envelope processing.

The similar two kinds of operations (a) and (b) are performed with respect to the negative side envelope processing in connection with the negative side swings of the given tone wave. For the negative side, however, the operation (a) is to form a negative envelope wave, to await and detect a zero cross time from the negative side to the positive side of the original tone waveform and to hold the negative side envelope wave level at such a detected time. The operation (b) for the negative side is to compare the waveform level of the original tone waveform with the held negative side envelope wave level and to release the so-far held negative side envelope wave level at the time when the absolute value of the original tone waveform exceeds the absolute value of the so-far held negative side envelope level. And then at this time point, the timing flag CMP is set to be "1".

To summarize the both sides of operations, the sequence will be:

1) positive side operation (a),
2) negative side operation (b), turning CMP=−1,
3) negative side operation (a),
4) positive side operation (b), turning CMP=1, and repeating the sequence of 1) through 4) thereafter.

The time span during which the timing detection flag CMP=1 is herein termed as "CMP+" and the time span where CMP=−1 is termed as "CMP−." Basically, the time length between the turning point to CMP 1 and the next turning point to CMP=1, or the time length between the turning point to CMP=−1 and the next turning point to CMP=−1 can be taken as the fundamental period (defining the tone pitch) of the input tone waveform. Thus measuring such time lengths a predetermined number of times, and averaging the measured time lengths, the pitch of the input tone waveform can be determined accurately. If the period of the tone waveform is to be determined based on the time length between the two turning points to CMP=1, the processing may be conducted only with respect to the positive side of the tone wave, and the negative side processing may be omitted, Further, the time span lengths may not necessarily be measured between the adjacent turning points to CMP=1 themselves, but may be measured between the two zero cross points immediately before the turning points to CMP=1. The idea is to determine the period of the input tone waveform based on (or using) the turning points to CMP=1 (or maybe CMP=−1). In the embodiment of the present invention, a number of successively occurring turning points to CMP=1 and turning points to CMP=−1 are taken for measuring the time span lengths in some different types of measuring patterns to find errors among those measured time span length, and such a measured time span length having a noticeable error among others would be omitted from determining the tone pitch. The error detection procedure will be described herein later in connection with a step 1110 in FIG. 13*b*.

In addition to the hold release operation at the time when the input tone wave level exceeds the so-far held envelope wave level in the operation (b) above, the envelope wave level holding is forcibly terminated at the time when the determined hold time has lapsed. For example, in FIG. 8, the operation (a) starts at the time 713 after the release of the preceding held envelope level and the envelope wave fraction 702*c* comes out, and the operation (b) starts at the zero cross time 714 and the held envelope wave level of 702*d* comes out. But at the time 715, the determined hold time 721 has lapsed, which forcibly releases the envelope level hold operation so that a new envelope wave fraction is started following the original tone waveform. This type of operation is included in the operation to neglect an erroneous detected period. This is because the time when the input tone waveform exceeds the held envelope wave level will be anticipated with some good accuracy where the detected pitch data have become stable, and a longer period (until the input tone wave exceeds the held envelope level) than a determined hold time (determined as 5% addition to the detected stable period) would be considered to have a significant error and inadequate to be used for determining the pitch of the tone waveform. This ensures the pitch detection with a good accuracy. At the time 716, the operation (a) ends and the operation (b) starts just like the time 714. At the time 717, the operation (b) ends and the operation (a) starts just like the time 713. At the time 718, the operation (a) ends and the operation (b) starts just like the time 714.

Now referring to FIGS. 9 and 10, a description will be made to explain the advantages in releasing the so-far held envelope wave level when the wave level of the input tone waveform exceeds the so-for held envelope wave level as included in the procedure shown in FIG. 8.

FIG. 9 is a waveform chart showing an overall view of the signal waves occurring in the pitch detection operation wherein no envelope level holding process takes place. In this example, responsive to an input waveform 801, a positive side envelope waveform 802 is formed. At the times 811 and 812, for example, when the input waveform 801 exceeds the envelope waveform 802, the flag CMP is set to be "1". The similar processing is conducted with respect to the negative side of the input waveform. The rectangular waveform 803 shows the state of the flag CMP taking values "1" and "−1" alternately. FIG. 9 shows a big peaks 821, 822, 823 and so forth in the positive side, for example, and accordingly such peaks will be considerably influence the pitch determination inherently. But, the peaks 831, 832 of some lower harmonics are contained in the input waveform, and these peaks 831, 833 are also picked up. And the flag CMP assumes rectangular changes at such time points accordingly. The span between the time 811 and the time 812 may be taken as the period erroneously.

FIG. 10 is a waveform chart showing an overall view of the signal waves occurring in the pitch detection operation wherein an envelope level holding process takes place. In this example, responsive to the input waveform 901 which is the same as the input waveform 801 of FIG. 9, a positive side envelope waveform 902 and a negative side envelope waveform. In this example, however, the envelope wave levels are held at the downward zero cross times of the input waveform to make held-level fractions 902*a*, 902*b*. As the peaks 931, 932 of the lower harmonics do not reach such held levels, no flag change time is detected at such points for inverting the CMP value. In the negative side of the input wave, however, many small peaks are detected to set CMP−, which do not change the rectangular wave polarities in the negative side. Consequently, the build-up times of the rectangular wave CMP will give an accurate pitch of the input waveform.

FIG. 11 shows a block diagram illustrating a functional configuration of an embodiment of the pitch detector unit 201 of FIG. 2. The operation is conducted by the associated software running on a personal computer.

A range limiting filter 1001 is to limit the input tone wave within a predetermined range based on the parameter TYPE. The parameter TYPE is to distinguish among normal, male voices and female voices, and the range is limited accordingly. The output from the range limiting filter 1001 is supplied to the input terminals A of comparators 1008 and 1009, respectively. The output from the range limiting filter 1001 is also supplied to a positive side envelope follower 1002, a negative side envelope follower 1003, a zero cross detector 1004 and a level detector 1005. This output from the range limiting filter 1001 corresponds to the original waveform 701 of which the pitch is to be detected.

The positive side envelope follower 1002 is to form an envelope waveform of the positive side of the input waveform as described with reference to FIGS. 8–10. The output envelope waveform from the positive side envelope follower 1002 are inputted to a holding unit 1006 for the positive side. The holding unit 1006 starts holding the level of the positive side envelope wave upon receipt of a hold start signal H supplied from a pitch determining unit 1010, and releases holding upon receipt of a reset signal R from the pitch determining unit 1010. The holding unit 1006 keeps outputting the level of the received wave at the moment the holding has started from the hold start time till the hold release time. From the hold release time till the hold start time, however, the holding unit 1006 outputs the through signal of the inputted waveform. The output from the holding unit 1006 corresponds to the waveform 702 of FIG. 8.

The output of the holding unit 1006 is inputted to the B terminal of the comparator 1008. The comparator 1008 compares the level of the input waveform as inputted at the input terminal A and the level of the output signal from the holding unit 1006 as inputted at the input terminal B, and outputs a notification signal to the pitch determining unit 1010 when A>B.

The negative side envelope follower 1003, a holding unit 1007 and a comparator 1009 conduct the similar processing for the negative side of the input waveform as the positive side envelope follower 1002, the holding unit 1006 and the comparator 1008 did for the positive side of the input waveform. The comparator 1009 is to compare the absolute value of the level of the input waveform and the absolute value of the output level of the holding unit 1007. The zero cross detector 1004 detects the zero cross time of the input waveform. The level detector 1005 detects the time when the level of the input waveform exceeds a predetermined threshold level TH.

The pitch determining unit 1010 controls the overall operation of the pitch corrector. In particular, the pitch determining unit 1010 outputs the hold start signal H and the reset signal R in order to realize the operation as described with reference to FIG. 8. The operation of the pitch determining unit 1010 will be described herein below in the above listed order of the positive side operation (a), the negative side operation (b), the negative side operation (a) and the positive side operation (b). The hold releasing operation will be also described. The same reference symbols (numbers) in FIG. 8 are used in the explanation.

1) Positive Side Operation (a): The pitch determining unit 1010 receives, from the zero cross detector 1004, the zero cross time 711 from the positive side to the negative side of the input waveform, and outputs the hold start signal H to the holding unit 1006 at this time. If a positive timer 1011 counts the determined hold time, the pitch determining unit 1010 also outputs the hold start signal H to the holding unit 1006, even if such a zero cross time from the positive side to the negative side is not detected.

2) Negative Side Operation (b): The pitch determining unit 1010 receives, from the comparator 1009, the time of |A|>|B|, and outputs the reset signal R to the holding unit 1007 at this time. Concurrently at this time, the pitch determining unit 1010 resets the negative side timer 1012 to start counting the hold time and set CMP="−1."

3) Negative Side Operation (a): The pitch determining unit 1010 receives, from the zero cross detector 1004, the zero cross time from the negative side to the positive side of the input waveform, and outputs the hold start signal H to the holding unit 1007 at this time. If a negative timer 1012 counts the determined hold time, the pitch determining unit 1010 also outputs the hold start signal H to the holding unit 1007, even if such a zero cross time from the negative side to the positive side is not detected.

4) Positive Side Operation (b): The pitch determining unit 1010 receives, from the comparator 1008, the time 713 of A>B, and outputs the reset signal R to the holding unit 1006 at this time. Concurrently at this time, the pitch determining unit 1010 resets the positive side timer 1011 to start counting the hold time 721 and set CMP="1."

As so far described, the pitch determining unit 1010 realizes the operations as explained with reference to FIG. 8. Further, the pitch determining unit 1010 determines the pitch from the time span lengths successively obtained from the rectangular wave defined by the CMP+ and the CMP−. The hold time is adjusted according to thus determined pitch.

FIG. 12 shows an embodiment of the positive side envelope follower 1002 in the pitch detector of FIG. 11. The positive side envelope follower 1002 includes a multiplier 1021, an adder 1022, a positive pass circuit 1023, a multiplier 1025, an adder 1026, a delay circuit 1027 and a multiplier 1028. The positive pass circuit 1023 is a circuit of a transfer characteristic as shown by the graph 1024, passing positive values as they are and rejecting negative values by outputting "0" value. According to the coefficients (c3, c,2) at the multipliers 1025, 1028 and the delay time at the delay circuit 1027 connected in a loop, the time constant for the envelope wave to follow the original waveform is determined, The negative side envelope follower 1003 is of the similar structure, using a negative pass circuit in place of the positive pass circuit 1023.

FIGS. 13*a* and 13*b*, in combination, describe a flow chart of the pitch detection processing performed by the pitch detecting block 201 of FIG. 2, especially by the pitch determining unit 1010 of FIG. 11. As the pitch detection processing starts, a step 1101 first judges whether the pitch sensitivity flag PITCHSENSFLG (the initial setting is "0") is zero or not. If the judgment is positive (YES), a step 1102 checks the level of the input waveform at the level detector 1005 of FIG. 11. Then, a step 1103 judges whether the level LEVEL is greater than a predetermined threshold TH. If the judgment is negative (NO), the process flow goes back to the step 1102. When the step 1103 judges that LEVEL>TH, the process flow goes forward to a step 1104. This judgment is to avoid erroneous detection of the pitches which would often occur when the magnitude of the input signal is not sufficiently large, and to secure the pitch detection about an input signal having a sufficient magnitude over the predetermined value.

The step 1104 checks the zero cross count of the input waveform and get the number ZEROX of detected zero crosses within a predetermined period of time. A step 1105 judges whether ZEROX<THZERO, where THZERO is a predetermined value. When the judgment is negative (NO), the portion of the currently inputted waveform is the consonant portion (as often found in a song with words) which is the span where the pitch detection is impossible having so many zero crosses. Then, a step 1106 outputs the judgment that the portion in question is a consonant portion and suspends the pitch detection. When the judgment at the step 1105 turns out to be affirmative (YES), it can be considered that to input waveform is now stable (e.g. vowel portion) for pitch detection. The process flow then goes forward to a step 1107 to set "1" in the pitch sensitivity flag PITCHSENSFLG, before going back to the step 1101.

If the step 1101 judges that the flag PITCHSENSFLG is not "0," the process flow moves to a step 1109 (FIG. 13*b*) to perform the operation described in FIG. 11 so that the pitch determining unit 1010 detects CMP+ and CMP− several times consecutively to measure a number of time span lengths from the rectangular waveform of CMP+ and CMP−, and outputs the determined pitch signal PITCH. A step 1110 evaluates a number of such detected data to calculate errors using several patterns (rules) of calculations. The patterns are as follows.

(1) Obtain the sum of two consecutive span lengths CMP+ and CMP− (this sum corresponds to one period) for a number of spans. With respect to the sum of the time spans in question, obtain the differential rate from the sum of the preceding time spans in a percentage notation, for example. The differential rate can be considered the error in that time span in question.

(2) Obtain the sum of two consecutive span lengths CMP− and CMP+ (this sum corresponds to one period) for a number of spans. With respect to the sum of the time spans in question, obtain the differential rate from the sum of the preceding time spans in a percentage notation, for example. The differential rate can be considered the error in that time span in question.

(3) Obtain the sum of four consecutive span lengths CMP+ , CMP−, CMP+ and CMP− (this sum corresponds to two periods) for a number of spans. With respect to the sum of the time spans in question, obtain the differential rate from the sum of the preceding time spans in a percentage notation, for example. The differential rate can be considered the error in that time span in question.

A step 1111 checks whether the thus obtained errors are all less than a predetermined value. If the judgment is affirmative (YES), process moves forward to a step 1112, which averages the thus measured values of the respective time spans to obtain a period, and outputs the detected pitch. Thereafter, a step 1114 sets "0" in the pitch sense flag PITCHSENSFLG before returning to the main routine. If the step 1111 judges there is a greater error than the predetermined reference value, the process flows to a step 1113 to notify the detected error, and thereafter to the step 1114.

In the above example, the pitch is detected and outputted when all the calculated errors are less than the predetermined value, and if there is at least one error which is greater than the predetermined value the error is notified. But practically in the inventor's embodiment, when the error obtained by the above pattern (1) or pattern (2) is greater than the predetermined value, the period data containing such a greater error is neglected, and the pitch is calculated from the average of other periods. If an error found according to the above (3) pattern is greater than the predetermined value, at least one of the two consecutive time spans should be considered to be erroneously detected. Then, further severe evaluation may be conducted using the errors obtained by the pattern (1) or (2) detection, or using other method to obtain the period of the previously obtained time span length including the error. In the FIG. 13*b* flow chart, the step 1109 detects a number of consecutive time span lengths CMP+ and CMP− and next the step 1110 evaluates the detected data to calculate errors, but the steps 1110 through 1113 may be repeated, every time a CMP+ or a CMP− is obtained, thereby outputting the detected pitches in real time.

FIG. 14 shows a modified procedure for the pitch detection as an improvement to that shown in FIG. 8. This embodiment employs, as its characteristic feature as compared with that of FIG. 8, a first and a second threshold levels "th−" and "th+" which are set by offsetting the zero level line to the negative direction and the positive direction, respectively, by a very small amount in the vicinity of the zero level line "0," for the zero cross detection. The downward zero crossing of the given waveform 1201 is detected at the time 1211 where the given waveform crosses the "th−" threshold. The same happens at the times 1214, 1216 and 1218. Although not depicted in FIG. 14, the zero crossing of the given waveform 1201 is detected for the process of the negative side envelope wave when the waveform 1201 crosses the "th+" threshold. These modifications are introduced here to provide some hysteretic allowance against the possible drift or fluctuation of the genuine zero level line. Other than the zero cross detection, the operations of FIG. 14 are the same as the operations of FIG. 8, wherein reference numerals 1201, 1202, 1202*a*, 1202*b*, 1202*c*, 1202*d*, 1211, 1212, 1213, 1214, 1215, 1216, 1217, 1218 and 1221 in FIG. 14 are labeled corresponding to the reference numerals 701, 702, 702*a*, 702*b*, 702*c*, 702*d*, 711, 712, 713, 714, 715, 716, 717, 718 and 721 in FIG. 8, respectively, to mean the similarly corresponding matters.

While particular embodiments of the invention and particular modifications have been described, it will, of course, be understood by those skilled in the art that various modifications and substitutions may be made without departing from the spirit of the present invention so that the invention is not limited thereto, since further modifications may be made by those skilled in the art, particularly in light of the foregoing teachings. It is therefore contemplated by the appended claims to cover any such modifications that incorporate those features of these improvements in the true spirit and scope of the invention.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus for correcting tone pitches of a tone waveform comprising:

a pitch detecting device which detects a tone pitch of a given tone waveform;

a correction target note pitch providing device which provides a correction target note pitch to which said tone pitch of said given tone waveform is to be corrected;

a pitch correcting device which corrects the detected tone pitch of said given tone waveform to said correction target note pitch;

a correction target note exhibiting device which includes indicator elements corresponding to respective note pitches for indicating said correction target note pitch by lighting a corresponding one of said indicator elements, said indicator element increasing its illuminance gradually to a maximum illuminance with a predetermined time constant to start lighting and decreasing its illuminance gradually to a minimum illuminance with a predetermined time constant to extinguish lighting, and which thus exhibits said correction target note pitch; and a pitch correction exhibiting device which exhibits the conditions of the pitch correction by said pitch correcting device.

2. An apparatus as claimed in claim 1, wherein said pitch correction exhibiting device exhibits said conditions of said pitch correction by exhibiting said detected tone pitch of said given tone waveform and an amount of pitch correction as corrected by said pitch correcting device from said detected tone pitch of said given tone waveform.

3. A computer program for correcting tone pitches of a given tone waveform containing program instructions executable by a computer which is connected to a display device, said program causing said computer to execute:

a pitch detecting step of detecting a tone pitch of a given tone waveform;

a correction target note pitch providing step of providing a correction target note pitch to which said tone pitch of said given tone waveform is to be corrected;

a pitch correcting step of correcting the detected tone pitch of said given tone waveform to said correction target note pitch;

a correction target note exhibiting step of exhibiting said correction target note pitch on said display device by indicating said correction target note pitch by lighting an indicator element correspondingly provided for each of respective note pitches, said indicator increasing its illuminance gradually to a maximum illuminance with a predetermined time constant to start lighting and decreasing its illuminance gradually to a minimum illuminance with a predetermined time constant to extinguish lighting; and a pitch correction exhibiting step of exhibiting the conditions of the pitch correction by said pitch correcting step.

4. A computer program as claimed in claim 3, wherein said pitch correction exhibiting step is to exhibit said conditions of said pitch correction by exhibiting said detected tone pitch of said given tone waveform and an amount of pitch correction as corrected by said pitch correcting step from said detected tone pitch of said given tone waveform.

5. An apparatus for detecting tone pitches of a given tone waveform comprising:

an envelope forming device which forms an envelope waveform of a given tone waveform;

a zero cross time notifying device which notifies zero cross times of said given tone waveform;

an envelope level holding device which holds the level of said envelope waveform at each of said notified zero cross times;

a hold release device which releases said level of said envelope waveform held by said envelope level holding device, every time the level of said given tone waveform exceeds said level of said envelope waveform held by said envelope holding device;

a pitch determining device which measures a predetermined number of time spans between the adjacent times of such releasing, averages said measured predetermined number of time spans, and determines the averaged period of said time spans to be the period, and in turn determines the pitch of said given tone waveform.

6. An apparatus for detecting tone pitches of a given tone waveform comprising:

a positive envelope forming device which forms a positive envelope waveform of a positive side of a given tone waveform;

a negative envelope forming device which forms a negative envelope waveform of a negative side of said given tone waveform;

a downward zero cross time notifying device which notifies downward zero cross times of said given tone waveform, said downward zero cross time being a time at which said given tone waveform crosses a first threshold level downward from the positive side to the negative side, said first threshold level being a negative level in the vicinity of zero level;

an upward zero cross time notifying device which notifies upward zero cross times of said given tone waveform, said upward zero cross time being a time at which said given tone waveform crosses a second threshold level upward from the negative side to the positive side, said second threshold level being a positive level in the vicinity of zero level;

a positive envelope level holding device which holds the level of said positive envelope waveform at each of said notified downward zero cross times;

a negative envelope level holding device which holds the level of said negative envelope waveform at each of said notified upward zero cross times;

a positive side hold release device which releases said level of said positive envelope waveform held by said positive envelope level holding device, every time the positive side level of said given tone waveform positively exceeds said level of said positive envelope waveform held by said positive envelope holding device;

a negative side hold release device which releases said level of said negative envelope waveform held by said negative envelope level holding device, every time the negative side level of said given tone waveform negatively exceeds said level of said negative envelope waveform held by said negative envelope holding device;

a pitch determining device which determines the pitch of said given tone waveform based on the times of such positive side releasing and negative side releasing.

7. An apparatus as claimed in claim 6, wherein said pitch determining device measures either a predetermined number of time spans each between the adjacent positive side releasing times or a predetermined number of time spans between the adjacent negative side releasing times, averages said measured predetermined number of time spans, and determines the averaged period of said time spans to be the period, and in turn, the pitch of said given tone waveform.

8. An apparatus as claimed in claim 6, wherein said pitch determining device evaluates errors in said positive side hold releasing times or in negative side hold releasing times in view of the so-far determined pitch, and does not use such releasing times each of which carries an error greater than a predetermined reference error value in determining said pitch of said given tone signal.

9. An apparatus as claimed in claim 7, wherein said pitch determining device evaluates errors in said positive side hold releasing times or in negative side hold releasing times in view of the so-far determined pitch, and does not use such releasing times each of which carries an error greater than a predetermined reference error value in determining said pitch of said given tone waveform.

10. An apparatus as claimed in claim 6, wherein said pitch determining device predetermines a hold time based on so-far determined pitch, said positive side hold release device forcibly releases the so-far held level of said positive envelope waveform when said hold time since the preceding downward zero cross time lapses before next said downward zero cross time comes, and forcibly releases the so-far held level of said negative envelope waveform when said hold time since the preceding upward zero cross time lapses before next said upward zero cross time comes, and said pitch determining device does not use such time span in determining said pitch of said given tone waveform.

11. An apparatus as claimed in claim 7, wherein said pitch determining device predetermines a hold time based on so-far determined pitch, said positive side hold release device forcibly releases the so-far held level of said positive envelope waveform when said hold time since the preceding downward zero cross time lapses before next said downward zero cross time comes, and forcibly releases the so-far held level of said negative envelope waveform when said hold time since the preceding upward zero cross time lapses before next said upward zero cross time comes, and said pitch determining device does not use such time span in determining said pitch of said given tone waveform.

12. An apparatus as claimed in claim 8, wherein said pitch determining device predetermines a hold time based on so-far determined pitch, said positive side hold release device forcibly releases the so-far held level of said positive envelope waveform when said hold time since the preceding downward zero cross time lapses before next said downward zero cross time comes, and forcibly releases the so-far held level of said negative envelope waveform when said hold time since the preceding upward zero cross time lapses before next said upward zero cross time comes, and said pitch determining device does not use such time span in determining said pitch of said given tone waveform.

13. An apparatus as claimed in claim 9, wherein said pitch determining device predetermines a hold time based on so-far determined pitch, said positive side hold release device forcibly releases the so-far held level of said positive envelope waveform when said hold time since the preceding downward zero cross time lapses before next said downward zero cross time comes, and forcibly releases the so-far held level of said negative envelope waveform when said hold time since the preceding upward zero cross time lapses before next said upward zero cross time comes, and said pitch determining device does not use such time span in determining said pitch of said given tone waveform.

14. A computer program for detecting tone pitches of a given tone waveform containing program instructions executable by a computer, said program causing said computer to execute:

an envelope forming step of forming an envelope waveform of a given tone waveform;

a zero cross time notifying step of notifying zero cross times of said given tone waveform;

an envelope level holding step of holding the level of said envelope waveform at each of said notified zero cross times;

a hold release step of releasing said level of said envelope waveform held by said envelope level holding step, every time the level of said given waveform exceeds said level of said envelope waveform held by said envelope holding device;

a pitch determining step of determining the pitch of said given tone waveform by measuring a predetermined number of time spans between the adjacent times of such releasing, averaging said measured predetermined number of time spans, and determining the averaged period of said time spans to be the period, and in turn, determining the pitch of said given tone waveform.

15. A computer program for detecting tone pitches of a given tone waveform containing program instructions executable by a computer, said program causing said computer to execute:

a positive envelope forming step of forming a positive envelope waveform of a positive side of a given tone waveform;

a negative envelope forming step of forming a negative envelope waveform of a negative side of said given tone waveform;

a downward zero cross time notifying step of notifying downward zero cross times of said given tone waveform, said downward zero cross time being a time at which said given tone waveform crosses a first threshold level downward from the positive side to the negative side, said first threshold level being a negative level in the vicinity of zero level;

an upward zero cross time notifying step of notifying upward zero cross times of said given tone waveform, said upward zero cross time being a time at which said given tone waveform crosses a second threshold level upward from the negative side to the positive side, said second threshold level being a positive level in the vicinity of zero level;

a positive envelope level holding step of holding the level of said positive envelope waveform at each of said notified downward zero cross times;

a negative envelope level holding step of holding the level of said negative envelope waveform at each of said notified upward zero cross times; a positive side hold release step of releasing said level of said positive envelope waveform held by said positive envelope level holding step, every time the positive side level of said given tone waveform positively exceeds said level of said positive envelope waveform held by said positive envelope holding step;

a negative side hold release step of releasing said level of said negative envelope waveform held by said negative envelope level holding step, every time the negative side level of said given tone waveform negatively exceeds said level of said negative envelope waveform held by said negative envelope holding step;

a pitch determining step of determining the pitch of said given tone waveform based on the times of such positive side releasing and negative side releasing.

* * * * *